United States Patent [19]

Krakauer

[11] 4,317,604

[45] Mar. 2, 1982

[54] ALL-PURPOSE MERCHANDISER

[76] Inventor: Merrill Krakauer, 1 Deer Path, Short Hills, N.J. 07078

[21] Appl. No.: 146,313

[22] Filed: May 5, 1980

[51] Int. Cl.[3] ..... A47F 1/00; A47B 49/00

[52] U.S. Cl. ..... 312/97.1; 312/125; 312/305; 312/223

[58] Field of Search ..... 312/97.1, 97, 91, 138 R, 312/305, 125, 135, 223

[56] References Cited

U.S. PATENT DOCUMENTS

| | | | |
|---|---|---|---|
| 1,416,566 | 5/1922 | McCleary | 312/305 |
| 1,717,943 | 6/1929 | Smith | 312/125 |
| 3,102,762 | 9/1963 | Johnson et al. | 312/97.1 |
| 3,135,567 | 6/1964 | Braunsberg | 312/97.1 |
| 3,146,043 | 8/1964 | Johnson et al. | 312/97.1 |
| 3,147,838 | 9/1964 | Mueller et al. | 312/97 |
| 3,158,417 | 11/1964 | Johnson | 312/97.1 |
| 3,243,034 | 3/1966 | Mueller et al. | 312/97 |
| 3,684,131 | 8/1972 | Kurimsky | 312/91 |
| 4,049,330 | 9/1977 | Schlapp | 312/97.1 |
| 4,118,082 | 10/1978 | Hoop | 312/97.1 |

*Primary Examiner*—Victor N. Sakran
*Attorney, Agent, or Firm*—Shenier & O'Connor

[57] ABSTRACT

An all-purpose merchandiser for vending articles of merchandise, such as platters of food, desserts and the like, having a wide variety of shapes and sizes in which a generally circular merchandise carrier having a plurality of storage levels each of which is divided into a plurality of compartments having transparent walls and bases is mounted for movement around a vertical axis to carry the compartments past a cabinet door window and past a plurality of transparent access doors disposed for sliding movement in superposed relationship on the cabinet door. The dimensions of the windows and the doors and the transparency of compartment walls and bases afford a potential customer with a view of more than half the compartments on the carrier without moving the carrier so that he is able to determine the presence of articles therein. Preferably the windows and the doors are in planes extending slightly rearwardly from the midpoint of the cabinet door.

25 Claims, 12 Drawing Figures

Fig 6
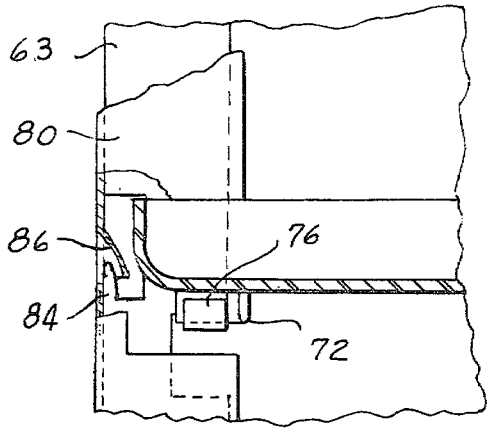
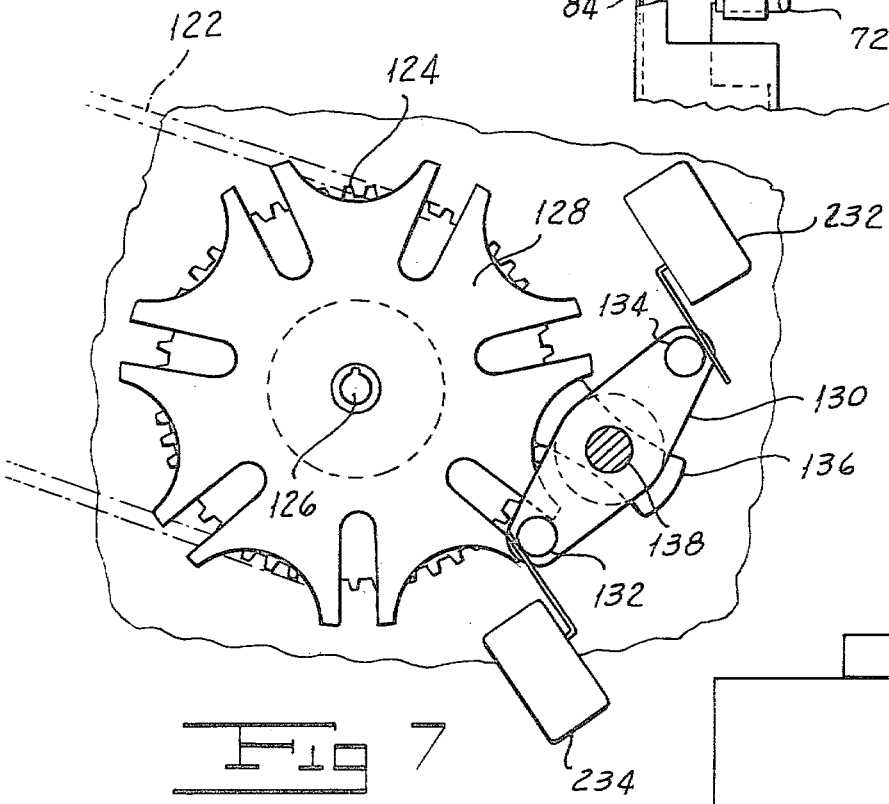
Fig 7
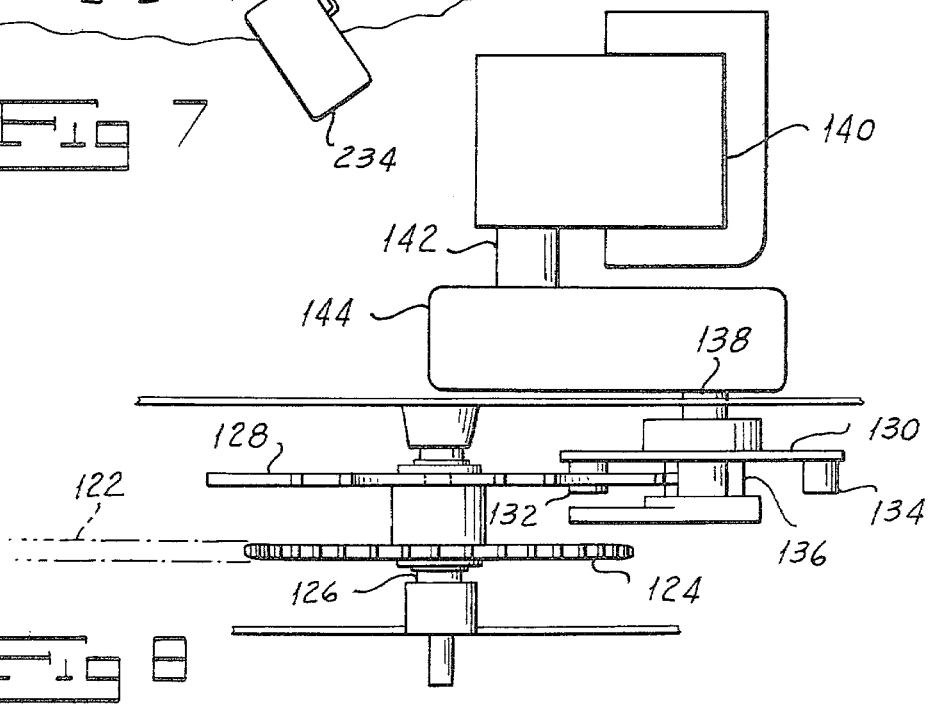
Fig 8

ALL-PURPOSE MERCHANDISER

BACKGROUND OF THE INVENTION

My invention relates to the field of merchandising machines and, more particularly, to an all-purpose merchandising machine, which is adapted to vend a plurality of articles having a wide variety of shapes and sizes.

There are known in the prior art merchandising machines of the type which are installed in manufacturing plant or office, dining areas for dispensing a wide variety of articles of merchandise having different shapes and sizes. Such merchandising machines have come into very wide use to permit of the purchase by a customer of a complete meal, including an entree, such as a hot plate or the like, as well as desserts and so forth, without requiring an attended counter. One such general merchandising machine is disclosed in Mueller et al U.S. Pat. No. 3,147,838, issued Sept. 8, 1964. In the arrangement disclosed in the Mueller et al patent, a plurality of columns of merchandise carrying compartment-forming members are supported for movement along a generally rectangular path, first past a viewing window in the door of the merchandising machine and then past a plurality of transparent access doors. Means is provided for selectively positioning one column of merchandise compartments behind the access doors. With the column of compartments so positioned and following the deposit in the machine of the purchase price of a desired article behind a particular door, that door can be opened to permit access to the compartment for delivery of the article of the merchandise carried therein. Kurimsky U.S. Pat. No. 3,684,131 issued Aug. 15, 1972 for Merchandising Machine with Size-Adjustable Compartments discloses an improvement on the Mueller et al machine, by virtue of which the height of the respective compartments in a column can be varied over the height of the column.

While the merchandising machines disclosed in the patents mentioned hereinabove effectively vend a relatively wide range of articles of merchandise, they are not as flexible as is required in the present market in which it is desirable that a full meal, including a hot plate, for example, be available to a prospective customer. While the Kurimsky patent discloses an arrangement for varying the heights of the respective compartments of a column, no means is shown therein or in the Mueller et al patent for varying the widths of the compartments of the machine from level to level, so as to afford an arrangement which, for example, permits the delivery of relatively wide articles, such as full platters in a number of levels of the machine, while at the same time permitting other levels of the machine to deliver relatively narrower articles, such for example as sandwiches and desserts, and the like.

In addition to the defect described hereinabove, machines of the type shown in Mueller et al embody a number of disadvantages. In order to achieve a relatively effective display of the articles of merchandise contained in the various columns of carriers, the carriers are caused to move around a generally rectangular path. This arrangement results in a machine which is relatively complicated in construction and operation and, consequently, expensive to construct and difficult to maintain. While other patents of the prior art disclose merchandise carriers comprising generally circular tiers of compartments adapted to move past access doors in the front of the cabinet, such machines do not afford as effective a display of the articles of merchandise on the carrier as is desired. In addition to the defects pointed out hereinabove, merchandising machine of the prior art have compartments formed of opaque material. As a result, since you don't know in what position the last customer left the carrier you cannot tell what is left in the machine.

SUMMARY OF THE INVENTION

One object of my invention is to provide an all-purpose merchandiser which overcomes the defects of general merchandisers of the prior art.

Another object of my invention is to provide an all-purpose merchandiser which is adapted concomitantly to vend relatively wide articles of merchandise, such as full platters and relatively smaller articles, such for example as packaged sandwiches or desserts, or the like.

A further object of my invention is to provide an all-purpose merchandiser which is relatively inexpensive in construction, while at the same time affording an effective display of the merchandise contained therein.

A still further object of my invention is to provide an all-purpose merchandiser which is relatively simple in construction and operation, while at the same time affording an effective display of the merchandise contained therein.

Yet another object of my invention is to provide an all-purpose merchandiser having carrier compartments of transparent material to afford a panoramic view of the merchandise.

Other and further objects of my invention will appear from the following description.

In general my invention contemplates the provision of an all-purpose merchandiser for concomitantly vending articles of merchandise, such as platters of food, packaged sandwiches, desserts and the like, having a wide variety of shapes and sizes, in which a generally circular merchandise carrier having a plurality of storage levels, each of which is divided into a plurality of compartments, is mounted for movement around a vertical axis to carry the compartments past a cabinet door window lying in a plane making an angle with the plane of the door and being substantially parallel to a plane tangential to the carrier and past a plurality of transparent access doors disposed for sliding movement in superposed relationship on the cabinet door in a second plane making an angle with the plane of the door and being substantially parallel to another plane tangential to the carrier.

The window has a width substantially equal to the length of a chord which subtends an arc occupied by a plurality of first vertically aligned compartments, while each door is of a length which is approximately equal to the chord subtended by the arc occupied by a second compartment adjacent to one of the first compartments. I position a vertically extending elongated source of illumination at a location adjacent to the line of intersection of said planes and adjacent to the outboard edges of the planes. Preferably, I divide the compartments of selected ones of said levels into two subcompartments and step the carrier in a number of steps per revolution which is equal to twice the number of full size compartments while preventing a door corresponding to a full size compartment level from being open when the carrier stops at a midpoint corresponding to a half compartment position.

BRIEF DESCRIPTION OF THE DRAWINGS

In the accompanying drawings to which reference is made in the instant specification and which are to be read in conjunction therewith and in which like parts are indicated by the same reference characters in the various views:

FIG. 6 is a fragmentary sectional view of the merchandiser carrier of my all-purpose merchandiser taken along the line 6—6 of FIG. 5.

FIG. 7 is a fragmentary view of a portion of the merchandise carrier drive mechanism of my all-purpose merchandiser.

FIG. 8 is a fragmentary elevation of the drive mechanism illustrated in FIG. 7.

DESCRIPTION OF THE PREFERRED EMBODIMENT

Figure 1:
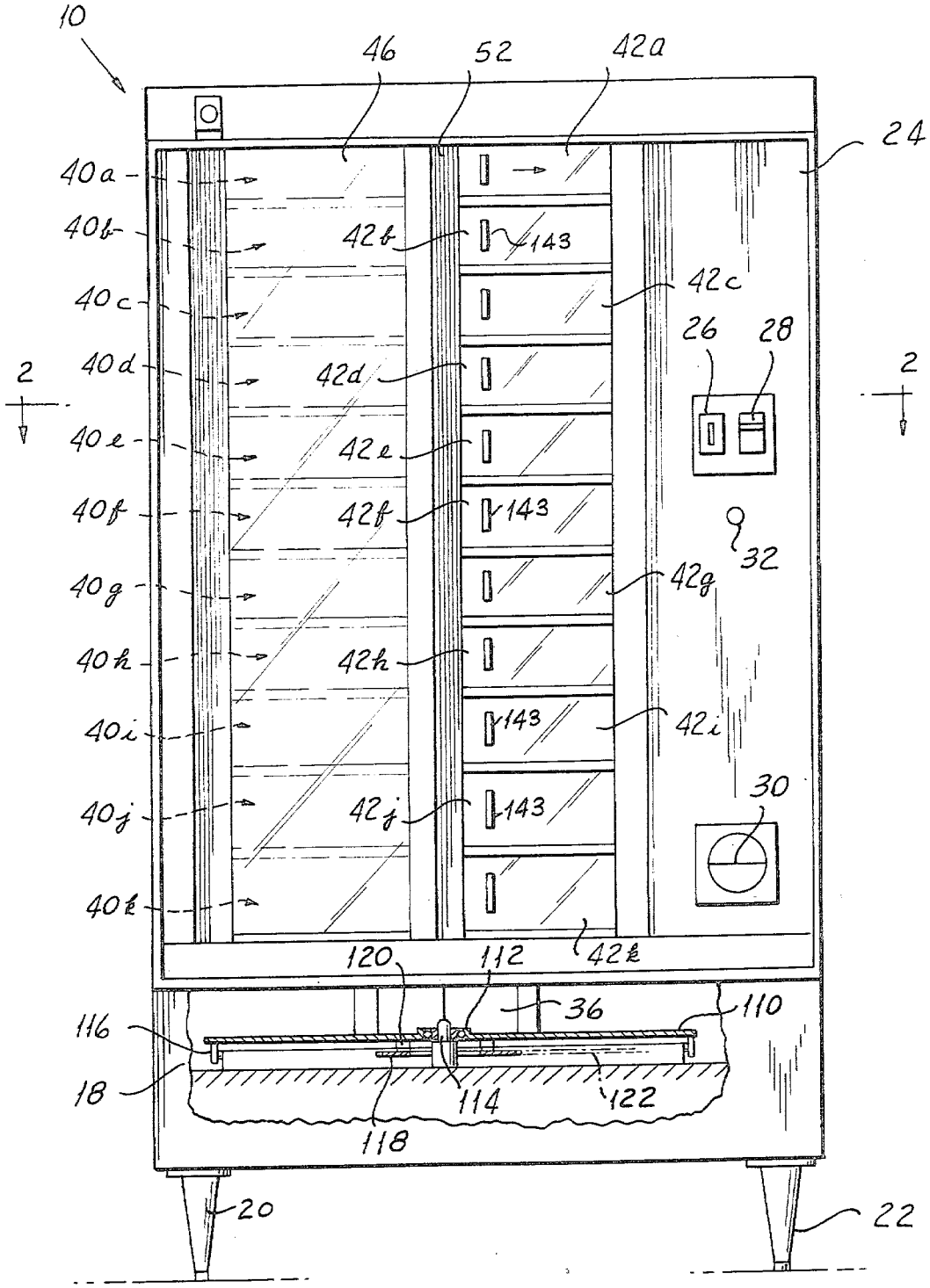
FIG. 1 is a front elevation of my all-purpose merchandiser with a part broken away and with other parts shown in section.
Figures 2, 3:
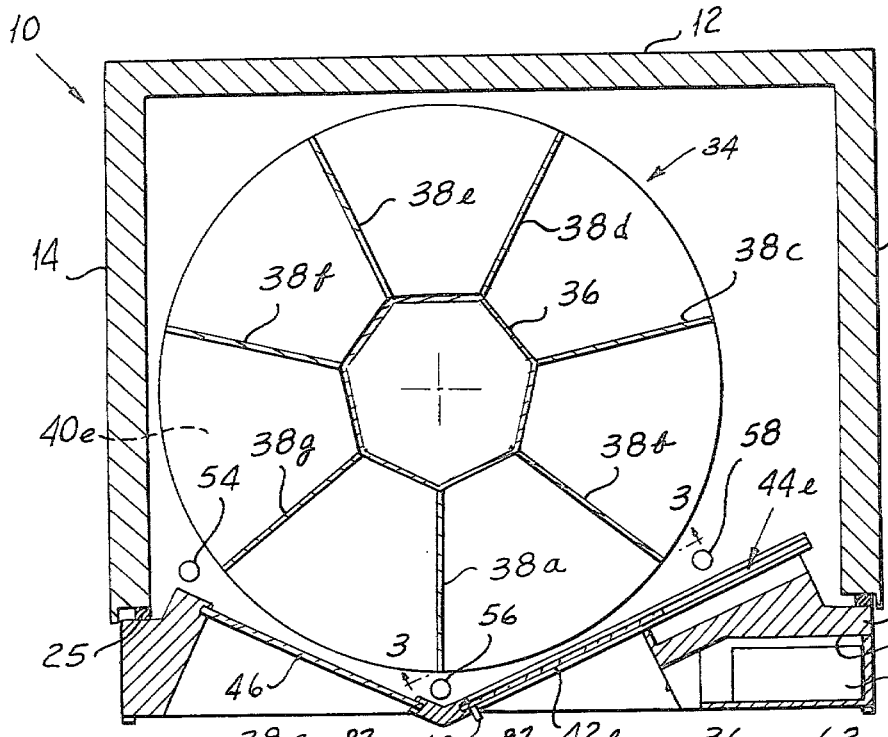
FIG. 2 is a sectional view of the form of my all-purpose merchandiser illustrated in FIG. 1 taken along the line 2—2 of FIG. 1.
FIG. 3 is a fragmentary front elevation of a portion of the merchandise carrier of my all-purpose merchandising machine.

Referring now to FIGS. 1 and 2 of the drawings, my all-purpose merchandiser indicated generally by the reference character 10 includes a cabinet having a back 12, sides 14 and 16, a front 18 and legs, two of which 20 and 22 are shown in the drawing. The cabinet door 24 is supported on a hinge 25 for movement between a closed position, which is the normal position of the door when the machine is in operation. When it becomes necessary to service the machine, the door 24 is moved to its open position. At the right hand side of the door 24 there are provided a coin slot 26, a coin return lever 28 and a coin return cup 30. A transport button 32 is adapted to be actuated to rotate the merchandise carrier indicated generally by the reference character 34 in a manner to be described. The merchandise carrier 34 includes a center column 36. In the particular embodiment of the machine illustrated in the drawings, column 36 in section is a seven-sided polygon. In a manner to be described more fully hereinbelow, I secure a plurality of vertically extending partitions 38*a* to 38*g* to the column 36 along the lines of intersection of the sides to divide the merchandise carrier 34 into seven sectors around the axis of the column 36. In addition in a manner to be described more fully hereinbelow, I divide the upper portion of the column 36 into 11 merchandise containing levels, indicated generally, respectively, by the reference characters 40*a* through 40*k*. The main door 24 supports a number of merchandise compartment access doors 42*a* through 42*k*, corresponding to the respective levels 40*a* through 40*k* for sliding movement from closed positions to open positions at which they permit access to the merchandise containers supported by column 36. I provide a door control mechanism indicated generally by the reference character 44 for each of the doors 42*a* through 42*k*. The cabinet door 24 also supports a window 46, which extends vertically through the space occupied by all of the merchandising levels 40*a* through 40*k* to permit the articles to be viewed by a prospective customer.

A sub-housing 48 on the back of the door 24 behind the coin slot 26 and coin return actuator 28 supports the coin mechanism 50.

The cabinet door 24 supports a vertically extending opaque post 52 disposed between the window 46 and the transparent doors 42. As can best be seen by reference to FIG. 2, the window 46 lies in a vertical plane which is inclined rearwardly from the plane of front 18 and which is parallel to a plane which is tangent to the carrier 34. Moreover, the window extends over a lateral distance which is substantially equal to the distance between the outer edges of a pair of partitions 38. Similarly, doors 42 lie in a plane which is inclined rearwardly from post 52 and which is substantially parallel to a plane tangent to carrier 34. The visible portion of each door in its closed position in a direction transverse of the machine 10 is approximately three-quarters of the distance between the outer edges of a pair of adjacent partitions 38. I position respective elongated vertically extending fluorescent bulbs 54, 56, and 58 within the cabinet respectively adjacent to side 14, so as to be just behind the left edge of the cabinet door 24 when the door is closed, behind the vertical divider 52, with the door closed, and behind the auxiliary housing 48 and adjacent to the outer edge of partition 38*b* as shown in FIG. 2. I have discovered that this relative angular disposition of the window 46 and the doors 42, as well as the location of the lamps 54, 56, and 58 provides an extremely effective display of the merchandise contained in the machine.

Referring now to FIGS. 3 to 6, each of the partitions 38 is secured to the column 36 by means of a pair of rear vertically extending frame members 60 and 62 which are secured to the partition 38 adjacent to the rear edge thereof by any suitable means, such for example as by rivets, or the like. Frame member 60 may be secured to the column 36 which is formed of sheet metal, by any suitable means, such for example as by welding. Preferably, I form each of the partitions 38 from a clear plastic material, such for example as Lexan, which is the registered trademark of General Electric Company for a thermoplastic polycarbonate resin. It will readily be appreciated that any other suitable transparent material having the required structural properties could be employed. I secure respective partition front frame members 63 running along the front edges of the partitions 38 to the partitions by any suitable means, such for example as by rivets, or the like.

The basic merchandise carrying unit of my machine is a tray 64, which is generally trapezoidal in shape when viewed from above but the front of which is arcuate. An upstanding peripheral lip 66 runs entirely around the edge of the tray 64. Each of the trays 64 is formed with a locating member 68 extending across the rear thereof and adapted to be received in a generally rectangular slot 70 formed in a side of the column 36. I form the underside of each of the shelves 64 adjacent to the front corners thereof with respective bosses 72 and 74 adjacent to the front corners thereof. Bosses 72 are adapted to be received in respective shelf-supporting and locating lugs 76 struck out of the front partition frame members 63 at one side thereof and at respective locations correspondingly generally to the locations of the openings 70 in the column 36. Similarly, the bosses 74 at the other corners of the trays are received in lugs 78 struck out of the other side of the frame member 63 at locations corresponding to the locations of the lugs 76. From the structure just described, it will be apparent that a tray 64 can readily be assembled on the carrier 34 by inserting locator 68 into opening 70 and permitting the bosses 72 and 74 to come into operative relationship with the lugs 76 and 78. It will further be appreciated that with the parts in this position, no tray 64 can be removed by drawing it directly radially outwardly of the column 36.

I provide my machine with means for locking the respective trays 64 in position on the column 36. Respective retainer channel members 80 adapted to be assembled over the outer edges of the front frame members 63 have side openings 82 which accommodate the shelf lip 66 as the channel members are assembled onto the frame members 63. In order to retain the channel members 80 in position on the frame members 63, I form each frame member 63 with a plurality of hooks 84 at spaced locations therealong. I stamp the cross web of the channel member 80 to form hook receiving elements or hangers 86, which are adapted to receive the hooks 84 when the channel members 80 are assembled on the frame members 63. In this manner, each of the trays 64 is locked in position on the column 36 so that it cannot be removed by a customer. In order to permit removal of any tray, the cabinet door 24 must be open, the channel member 80 disassembled from the frame 63 and the front of the tray first lifted to bring the bosses 72 and 74 out of operative relationship with the retainer supports 76 and 78 and the tray then drawn away from the column 36. Each channel 80 is releasably locked to the top and bottom disks or plates of the carrier 34 by any suitable means (not shown).

Preferably, the trays 64 are molded from a suitable transparent plastic, such for example as Lexan. It will be appreciated that the frame members 60, 62 and 63 and the channel members 80 are formed of a suitable sheet metal.

Figure 5:
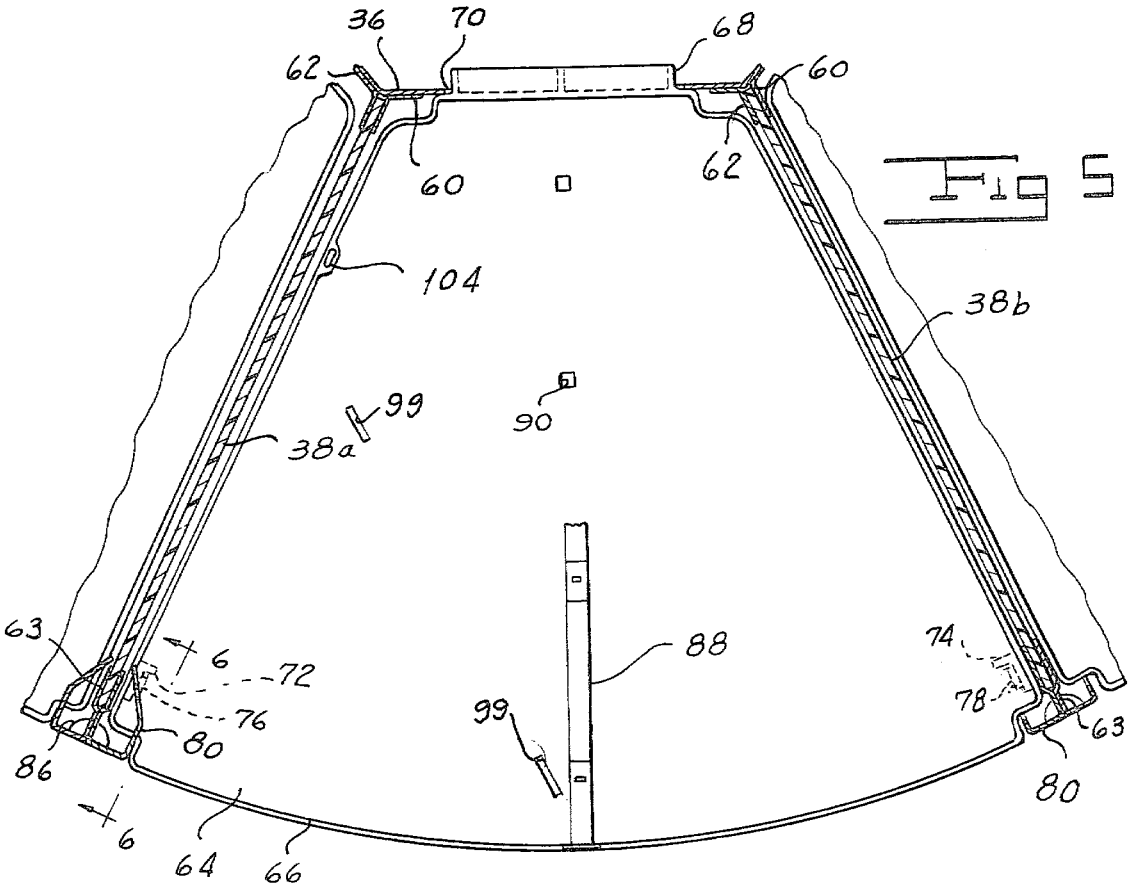
FIG. 5 is a fragmentary sectional view of the merchandise carrier of my all-purpose merchandiser taken along the line 5—5 of FIG. 3.

I provide my machine 10 with means for doubling the capacity by dividing the space occupied by each tray into two parts. As a first way of accomplishing this result, as shown in FIGS. 3 and 5, I may provide a tray, such as that associated with level 40*c* with a radially extending divider 88 provided with lugs 89 or the like along the top and bottom edges thereof, adapted to be received in mounting holes 90 formed in the bottom of the tray 64 which receives the divider and in the bottom of the tray 64 immediately thereabove.

Figure 4:
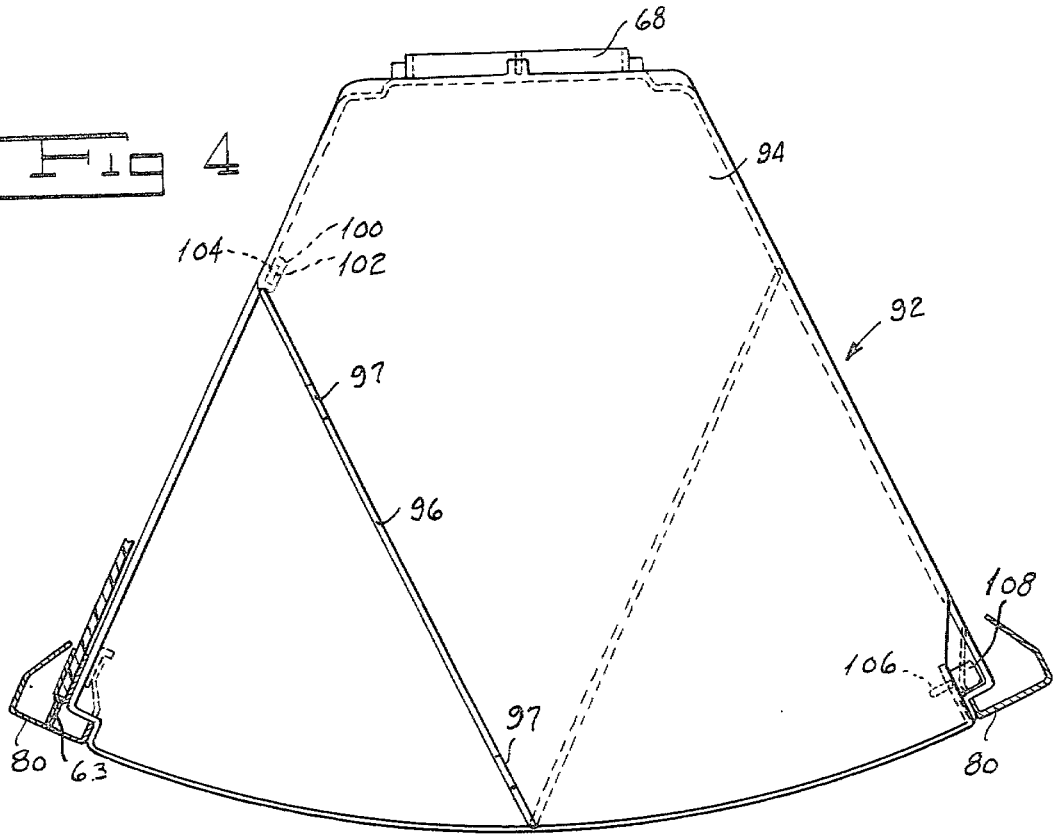
FIG. 4 is a fragmentary sectional view of one level of the merchandise carrier of my all-purpose merchandiser taken along the line 4—4 of FIG. 3.

As an alternative to the radially extending divider 88 and in order to make more effective use of the space associated with the tray 64, referring now to FIGS. 3 and 4, my shelf dividing member indicated generally by the reference character 92 for accomplishing this result includes a platform 94 located approximately half way between the merchandise supporting surface of the tray with which it is associated and the bottom of the next upper tray. I form the member 92 with a first baffle 96 for preventing access to the space above the platform 94, while permitting access to the space below. A second baffle 98 prevents access to the space below the divider 94. I form the member 92 with a first foot 100 having a reduced lower portion 102 adapted to be received in a recess 104 formed in the lip 66 of the associated tray 64. A second leg 106 extending downwardly from the underside of support 94 is adapted to rest on the bottom of the tray 64. This leg is formed with a lateral extension 108 which assists in locating the member 92 on its associated tray. Lugs 97 at spaced locations along the upper edge of baffle 96 are received in openings 99 in the tray 64 immediately thereabove.

It will readily be appreciated that where a tray at any level is divided so as to double its capacity in terms of the number of articles, all trays on the same level must be so divided. Moreover, as will more fully be explained hereinbelow, I so arrange my machine that the carrier 34 moves in steps which are equal to half the sector occupied by one of the trays 64. Further, where the trays of any row are not divided, all trays of that row must be so used. In this instance as will be explained hereinbelow, I prevent the corresponding merchandise access door from being open when the carrier is in a mid-step position. Further, as will be pointed out more fully hereinbelow, when the trays of any row are divided in two the associated door is limited to half the opening movement of which it normally is capable.

Referring now to FIGS. 1, 7 and 8, the carrier 34 includes a bottom plate 110, which is centered for rotary movement by means of a bearing 112 surrounding a central pivot 114. Any suitable means, such for example as rollers 116 support the weight of the carrier 34 and the merchandise supported thereby. I secure a sprocket wheel 118 to the plate 110 by any suitable means, such for example as by bolts 120, or the like. A pitch chain 122 operatively engages the sprocket wheel 118 to drive the carrier 34 in a manner to be described.

Chain 122 extends from the sprocket wheel 118 to a sprocket wheel 124 carried by a shaft 126. The diameter of the wheel 124 relative to that of the wheel 118 is such that one revolution of the wheel 124 corresponds to a half revolution of the wheel 118. Stated otherwise, if wheel 124 is stepped through one-seventh of a revolution, wheel 118 moves through one-fourteenth of a revolution, or an angular distance which is equal to one-half of the angular space occupied by one of the trays 64.

I mount a geneva drive wheel 128 on shaft 126 for rotation therewith. The drive member 130 associated with wheel 128 has respective pins 132 and 134 adapted to engage in the radial slots of the wheel 128 and a locator element 136 adapted to cooperate with the arcuate spaces between adjacent radial slots of the wheel 128. Driver 130 is carried by a shaft 138 for rotation therewith. A motor 140 is adapted to be energized in a manner to be described to cause its output shaft 142 to drive a speed reducer 144, the output shaft of which is shaft 138.

Referring now to FIGS. 1 and 9 to 11, by way of example I have shown the two upper doors 42*a* and 42*b* and their associated control mechanism 44*a* and 44*b* with the parts of the upper door 42*a* shown in the relative positions occupied thereby when the door is closed. The parts associated with door 42*b* are shown in the positions they occupy when the door is partially open.

The cabinet door 24 supports a plurality of vertically spaced horizontally extending door guides 146, each of which is formed with an upper guide track 148 and a lower guide track 150. Moreover, each of the doors 42 is formed with a handle 143 which facilitates movement of the door by a customer. I form the inner corner of each door 42 with a recess 154, which in the closed position of the door receives the upstanding lug 158 of a lock pawl 156 rotatable on a pivot shaft 160. The doors 42 normally are urged to closed positions by constant force springs 162, one end of each of which is secured to the inner end of the door by any suitable means, such as a lug 163 and the other end of which is secured to a spool 164 supported by a pin 166 carried by a bracket. A pawl stop arm 168 supported on a pivot pin 172 normally is positioned in the path of a generally radially extending stop surface 170 on the pawl 156, so that the pawl cannot normally be moved by the door to a position at which the door is sufficiently open to permit the customer to gain access to the merchandise. Shaft 172 also supports a stop arm catch 174. A spring 176 connecting catch 174 and arm 168 urges these elements together to move as a unit. A spring 178 extending between the member 174 and a pin 180 on the door 24 normally urges the members 174 and 168 to rotate as a unit in a counterclockwise direction as viewed in FIG. 9. I form the member 174 with a nose 182, which normally rests on a bell crank arm flange 184 of a bell crank 183 when the door is closed. A spring 186 normally urges the bell crank 183 to rotate in a counterclockwise direction around a pivot pin 196. I connect the armature 188 of a solenoid 190 to the member 174. When solenoid 190 is energized, it pivots latch 174 and stop arm 168 in a clockwise direction around the pin 172 to the position shown of the parts associated with door **42*b* and FIG. 9, in which position arm 168 is out of the path of movement of stop surface 170**, so that the door can be moved to its fully open position.

Figure 9:
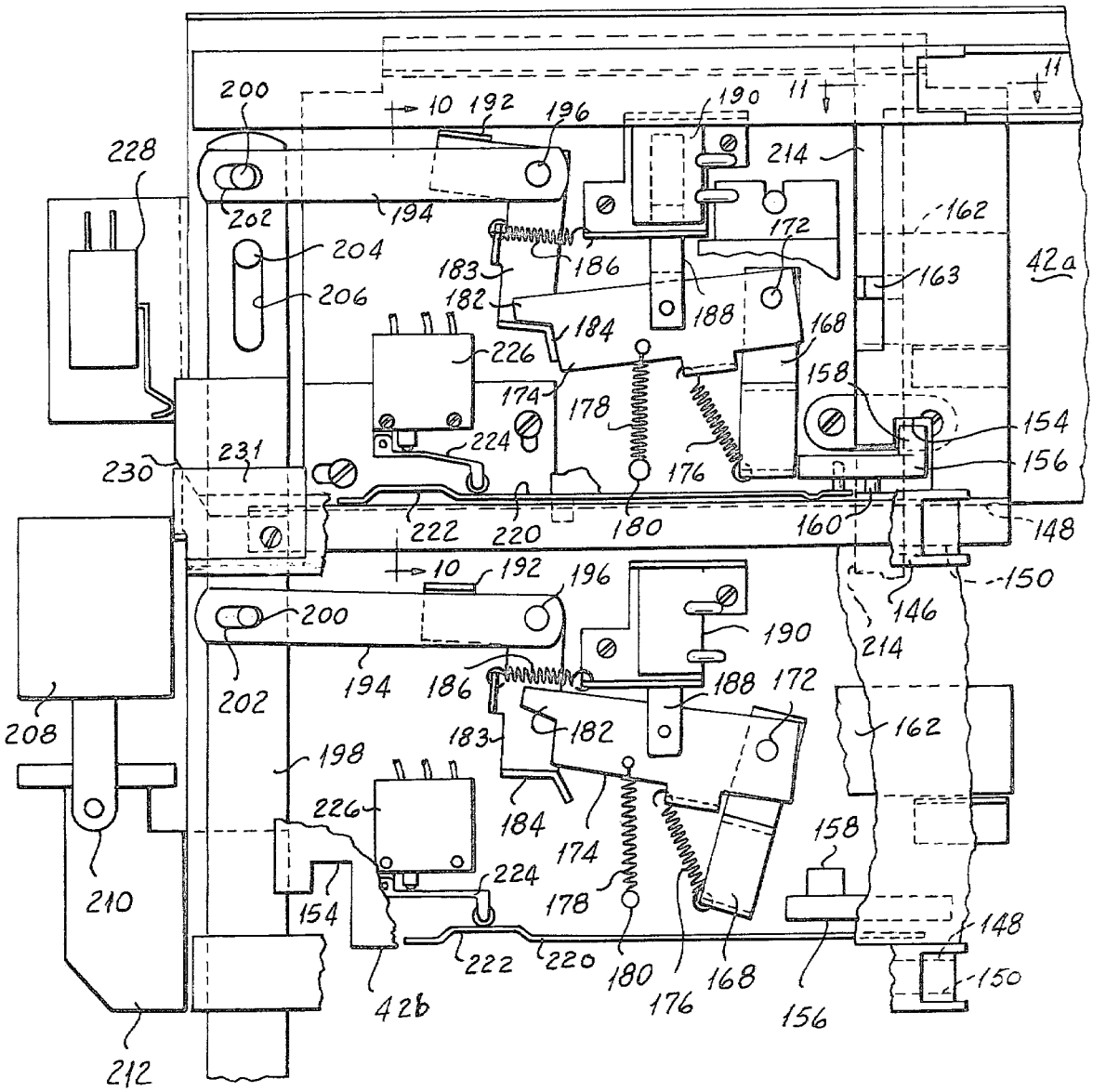
FIG. 9 is a fragmentary elevation of the door control mechanism of my all-purpose merchandiser with parts broken away and with other parts shown in section.
Figure 10:
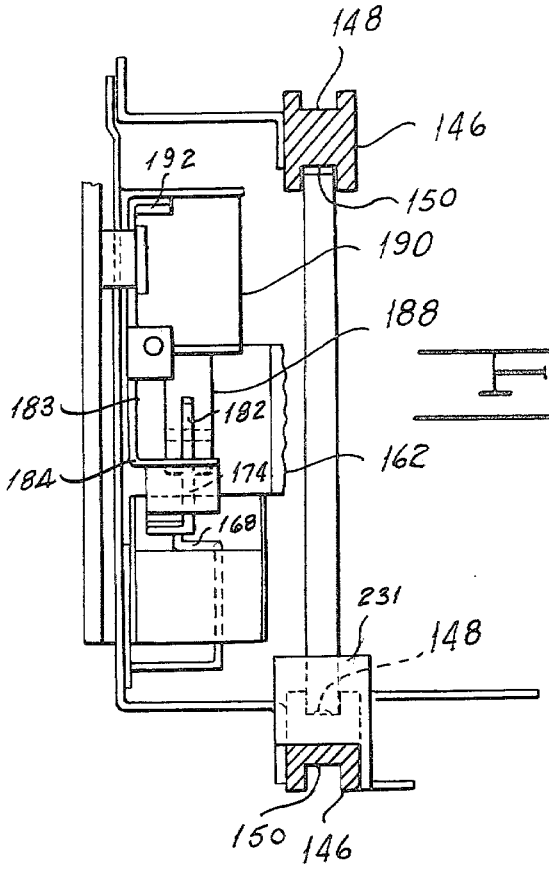
FIG. 10 is a fragmentary sectional view of the door control apparatus illustrated in FIG. 9 taken along the line 10—10 thereof.
Figure 11:
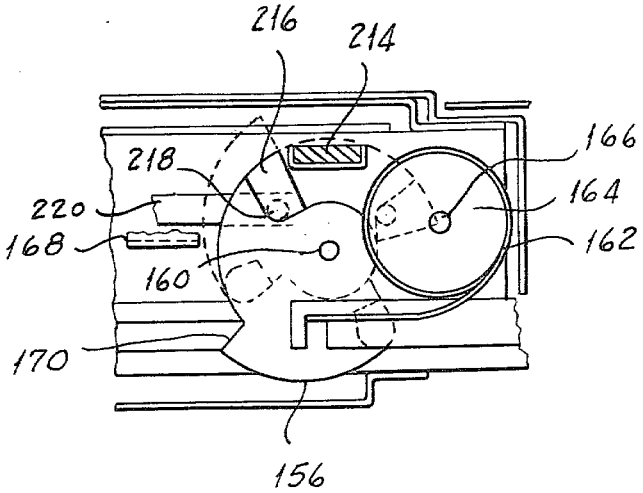
FIG. 11 is a fragmentary sectional view of the door control mechanism of my all-purpose merchandiser taken along the line 11—11 of FIG. 9.

When the parts have been moved in a manner described hereinabove, to the position corresponding to the door release position, a second flange 192 on the other arm of bell crank 183 comes to rest on the upper surface of a reset link 194 pivotally supported on pin 196. A reset bar 198 carries pins 200 which are received in slots 202 in the reset arms 194. Rod 198 is supported for vertical reciprocating movement on the door 24 by means of pins and slots, one pin 204 and one slot 206 of which are shown in FIG. 9. A solenoid 208 has an armature 210 connected by a bracket 212 to the reset bar 198, so that when the solenoid is energized the bar 198 will move upwardly to pivot link 194 in a clockwise direction to rotate the bell crank to a position at which spring 178 can reset latch 174 and stop arm 168.

I provide a plurality of interlock bars 214 associated with the respective doors. As a pawl 156 is rotated in response to movement of a door toward its open position a cam surface 216 thereon moves inbetween the ends of two adjacent bars. This action in a manner known to the art prevents the concomitant opening of more than one of the doors. Each pawl 156 receives a pin 218 carried by a slide 220. Each slide 220 is provided with a boss 222. As a pawl 156 rotates in the course of opening movement of a door, the associated slide 220 moves to the right as viewed in FIG. 9 to cause the boss to move into engagement with the actuating arm 224 of a switch 226. It is to be noted that the movement of pawl 156 which causes the boss 222 to actuate the arm 224 is not sufficient to bring stop 170 into engagement with the stop arm 168. As will be explained more fully hereinbelow, if at the time the boss 222 operates arm 224 to close switch 226 sufficient money has been deposited in the machine to make a purchase, the associated solenoid 190 will be energized to move the stop 168 out of the path of stop surface 170 to permit the door to be moved to its fully opened position. A cam 230 on the reset bar 198 operates a reset switch 228 when the reset operation takes place.

As has been explained hereinabove, at a predetermined number of levels the trays 64 are so divided as to form two compartments. In such an instance I provide means for limiting the movement of the door from fully closed position to half-open position. For example, I may removably secure a positive stop 231 on the lower guide track 148 at a location at which it is engaged by the inner edge of the door when the door is in half-open position. If desired I may vary the height of the respective levels in the manner taught by the Kurimsky patent cited hereinabove.

Figure 12:
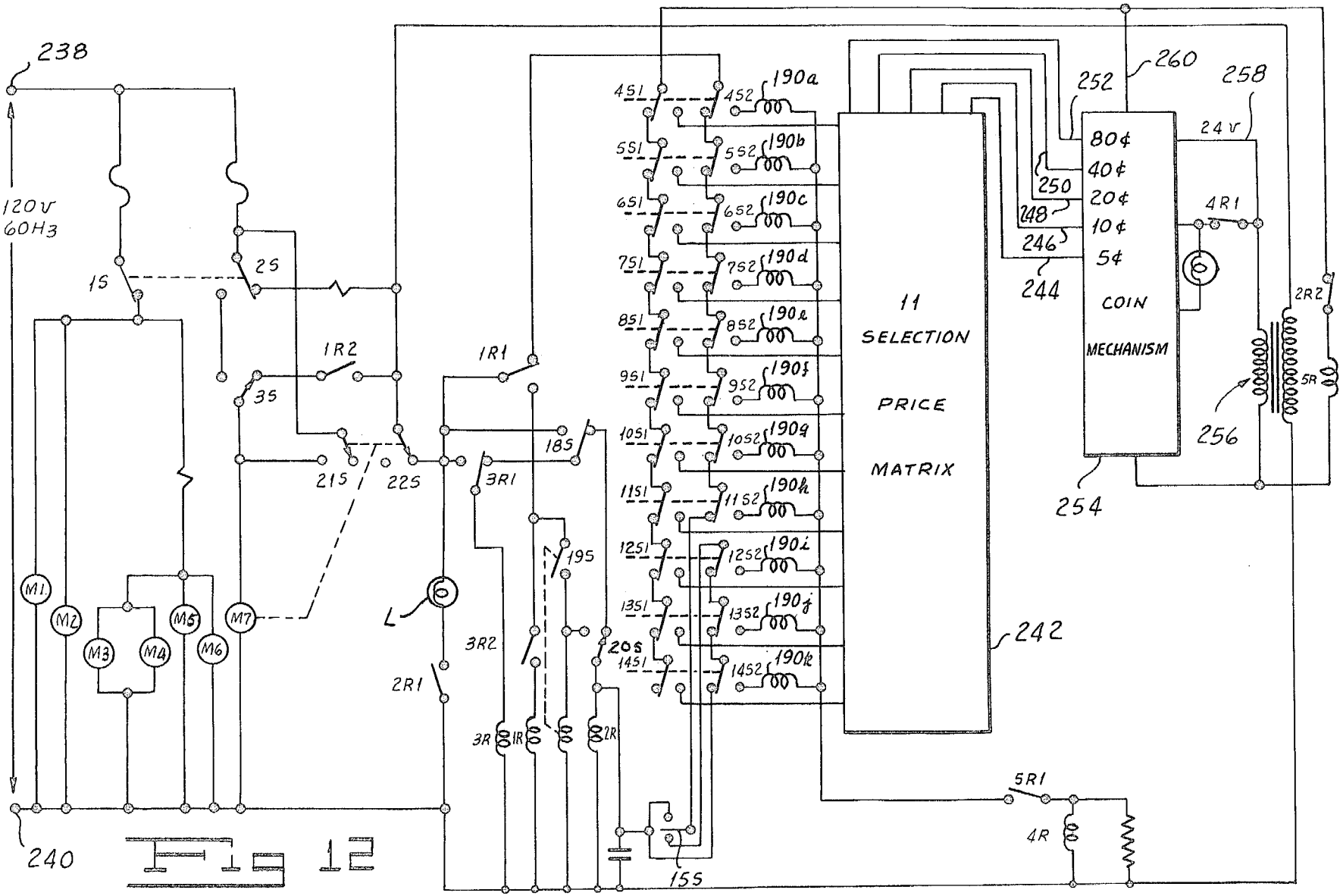
FIG. 12 is a schematic view of one form of control circuitry which may be used to control the operation of my all-purpose merchandiser.

Referring to FIG. 12, the electrical circuitry associated with the merchandising 10 includes a source of voltage such for example, as a 120 volt, 60 Hertz source having terminals 238 and 240. A door interlock switch includes ganged arms, one arm 1S of which is adapted to energize evaporator fan motors M1 and M2, condenser fan motors M3 and M4 and compressor motors M5 and M6. The other door interlock switch 2S is adapted to apply power to the power circuit of the machine when the door is closed. When the machine door is open so that switches 1S and 2S occupy positions other than those shown in FIG. 12, a service switch 3S may be operated to energize transport motor M7, which is identified by the reference character 140 in FIG. 8.

By way of example, in the circuit shown in FIG. 12, I have illustrated eleven selection switches associated with the eleven doors **42*a* to 42*k* of the machine 10. These selection switches are identified by the reference character 226 in FIG. 9. In FIG. 12 for purposes of clarity, I have designated the respective selection switches as 4S through 14S. It will be seen that each of these selection switches has a pair of poles designated, for example, as 4S1 and 4S2** for the first selection afforded by the machine.

As has been pointed out hereinabove, I arrange my machine so that some of the levels **40*a* to 40*k* contain twice the number of articles to be dispensed as do the other levels. Moreover, the carrier 34 is adapted to stop in 14 discrete positions in the particular embodiment illustrated in the drawings. It will readily be appreciated that the carrier may stop in a position corresponding to the midpoint of one of the levels which uses full trays 64 for the dispensing units. I so arrange my machine as to prevent opening of the door associated with a full tray level when the carrier 34 stops at a midpoint. To this end, in response to the carrier drive a switch 15S, identified by the reference character 232 in FIG. 7 occupies a position in which it engages the upper one of its associated contacts when the carrier 34 is at a midpoint and a position at which it engages its lower contact when the carrier is at a position between a pair of midpoint positions which is a position at which a full tray 64 is aligned with a door. In the particular arrangement of FIG. 12, I have shown the normally engaged contact of switch 11S2 as being connected to the contact arm of switch 15S and have shown the contact arm of switch 12S2 as being connected to the lower contact of switch 15S**.

The machine control circuit includes a door open relay winding 2R adapted when energized to open a normally closed switch 2R1 and to close a normally open "enable vend" switch 2R2. In the normal condition of the circuit with power up and with all of the doors closed, winding 2R is energized from terminal 238 through switch 2S, a normally closed transport motor full cycle switch 22S, a normally closed transport motor relay switch 1R1, all of the switches 4S2 through 14S2 and switch 15S with switch 15S in the down position, or through switches 4S2 to 11S2 and switch 15S with switch 15S in the up position to the winding 2R and thence to terminal 100. If any door is not fully closed its associated switch such as 4S2 for example, will be in a position other than that illustrated in FIG. 4 so that the circuit to winding 2R is not complete. Under these conditions, switch 2R closes to complete the circuit of lamp L to indicate that a door is open at the same time switch 2R2 is open so that no sale can be made.

With all of the doors closed so that power is applied to the upper terminal of winding 2R the circuit to relay winding 3R is complete through transport motor switch 20S through a single revolution transport switch 18S and through switch 3R1 to the winding 3R. Upon its energization winding 3R moves switch 3R1 to a position at which it completes the winding holding circuit. At the same time it readies the transport motor relay circuit by closing switch 3R2.

Under the conditions described above, in order to move the carriers past the doors and to position any carrier behind any particular door the customer actuates button 30 to move switch 20S from the position shown in FIG. 12 to its other position to complete the circuit of lock-up bar solenoid 208 to reset all of the door locking arms 168 and to close a switch 19S to complete the circuit of winding 1R. Energization of winding 1R moves contacts 1R1 from the position shown in FIG. 12 to its other position to hold the circuit of winding 1R through a normally closed switch 22S of the one revolution switch associated with the transport motor M7. At the same time switch 1R2 is closed to energize the transport motor M7. As soon as the motor begins to drive it opens switch 22S to interrupt the holding circuits of winding 3R and 1R and to complete its own holding circuit through a normally open switch 21S. The motor M7 maintains this condition of the two switches 21S and 22S for a single revolution of the motor shaft. At the end of a revolution the compartment carrier stops with one column of half trays or full trays precisely in registry with the column of doors 42. With the transport mode switch 18S in the position as shown, the button 32 must be released and then pressed again before another revolution of the transport motor can be initiated. This is because relay coil 3R cannot be returned to its "held" position through 3R1, 18S, and 20S. Switch 20S keeps this circuit open when button 32 is held in. If switch 18S is changed to its other position, then continuous motor operation is achieved with button 32 held in because relay coil 3R is returned to its "held" position through 22S, 18S, and 3R1. Transport switch 20S, actuated by button 32, is not involved.

I connect one terminal of the solenoid 190 of a selection unit to the normally open contact of the corresponding S2 switch pole and connect the other terminal of the solenoid to a normally open switch 5R1 adapted to be closed to connect the solenoid to terminal 240 through a suitable resistor. Thus, referring to FIG. 12 it will be seen that I connect the respective first terminal of solenoids 190*a* through 190*k* to the normally open switch contacts associated with switch poles 4S2 through 14S2. I connect the respective normally open contacts associated with switch poles 4S1 through 14S1 to an eleven selection price matrix 242. The outputs of the price matrix 242 are provided by the price lines 244, 246, 248, 250 and 252 of a coin mechanism 254. A step-down transformer indicated generally by the reference character 256 connected across the terminals 238 and 240 puts out 24 volts on a line 258 as an input to the coin mechanism 254. As will be explained more fully hereinbelow, the coin mechanism 254 continually puts out interrogating pulses on a line 260 which is connected to the series connected switch poles 4S1 to 14S1. The vend enable relay switch 2R2 and a vend relay winding 5R are connected in series between line 260 and the lower terminal of the secondary of transformer 256. However, the magnitude of the pulses put out on line 260 is not sufficient to energize winding 5R.

From the structure just described it will be appreciated that if an attempt is made to open a door so that the corresponding switch pole such as 4S1 for example is in engagement with its normally open contact, the interrogating pulses on line 260 will be applied to the matrix 242. At the same time, a circuit is complete from terminal 238 to the normally open contact of the switch pole 4S2 for example, connected to solenoid 190*a*. The other terminal of the solenoid, however, is open. It will be appreciated that if switch 15S is in its midpoint position at which it engages its upper contact, no circuit can be completed from terminal 238 to the switches 12S2 to 14S2 upon actuation of their associated doors. That is to say, in the particular setup which I have shown in FIG. 12 levels 40*i* to 40*k* have been set to sell full tray items, while all other levels have been set to sell half-tray items. It will readily be appreciated that the setup can be varied as desired.

The details of the remainder of the control circuitry which I employ are more fully shown and described in the copending application of David Hoffman, Ser. No. 98,772, filed Dec. 3, 1979, for Coin Mechanism to Merchandising Machine Interface, now U.S. Pat. No. 4,284,184. As is pointed out therein, if a price corresponding to the price of any of the price lines 244, 246, 248, 250, and 252 has been deposited in the coin mechanism and if the matrix couples the operated selection switch to that price line then the coin mechanism puts out a signal of 24 volts on line 260 which is sufficient to energize winding 5R to close contacts 5R1 to energize solenoid 190*a* to release the associated door lock. At the same time, winding 4R is energized to open the reset relay contacts 4R1 to reset the coin mechanism.

The construction in operation of my all-purpose merchandiser will readily be apparent from the description hereinabove. As is necessary or desirable in order best to serve the customers using the machine, various ones of the levels 40*a* through 40*k* may be set to deliver articles from full trays 64 or from half trays. Where a level is set to deliver articles of merchandise from full trays, its associated selecting solenoid winding 190 is connected to switch 15S so as to prevent the door from being opened if the carrier 34 has stopped at a midpoint. Where a particular level is adapted to deliver articles of merchandise from half compartments, the associated door 42 is provided with a stop 231 which limits movement of the door from the closed position to a half open position. The transport button 32 may be operated to move the carrier continuously around its vertical axis in fourteen steps of movement per revolution. After a desired article has been positioned behind its associated door and a sum aggregating the price of the article has been deposited in the machine, a purchase may be made by moving the door toward its open position in the manner described hereinabove.

By way of example, I have illustrated switch 15S as switch 232 and have illustrated ganged switches 21S and 22S as switch 234 in FIG. 7 with both switches being operated in response to the angular position of shaft 138. It will readily be appreciated that I could stack all three switches, locate them above motor 144 and have them operate in substantially the same manner in response to shaft 138.

Owing to the fact that the merchandise compartments of my machine are formed of transparent material, the customer is able to view approximately seventy percent of the compartments. At the same time, the center column of the carrier is opaque, so as not to confuse the view.

It will be seen that I have accomplished the objects of my invention. I have provided an all-purpose merchandiser which overcomes the defects of general merchandisers of the prior art. My all-purpose merchandiser is more versatile than are general merchandisers of the prior art, in that it readily dispenses articles making up a complete meal including, for example, a hot platter, desserts and the like, as well as sandwiches, which articles have a wide variety of shapes and sizes. My all-purpose merchandiser readily permits of doubling the number of compartments at any given level in the machine, while at the same time permitting other levels to deliver articles from the compartments of normal size. My all-purpose merchandiser is relatively simple in construction, while at the same time affording an effective display of the merchandise contained therein. It provides a panoramic view of the merchandise.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. An all-purpose merchandiser adapted to vend articles over a wide range of shapes and sizes including in combination a cabinet having a front, a generally circular merchandise carrier within said cabinet, said carrier comprising a center column, a plurality of vertically extending partitions of transparent material supported on said carrier at substantially equal spaced locations therearound to divide said carrier into a plurality of sectors, a plurality of respective merchandise receiving trays, means removably supporting said trays between adjacent pairs of said panels, a plurality of said trays being supported on said panels at vertically spaced locations to divide said carrier into a plurality of levels, a window of transparent material on said front, said window being located in a plane inclined rearwardly from a line relatively adjacent to the center of said front and being substantially parallel to a plane which is tangent to said carrier, a plurality of transparent access doors mounted in said front for movement between open positions and closed positions at levels corresponding to said carrier levels, said doors in said closed positions lying in a plane inclined rearwardly from a line relatively adjacent to the center of said front and generally parallel to a plane tangent to said carrier each of said window and said doors having a width approximately equal to the length of a chord subtended by the space occupied by one of said trays, each of said doors having a normal ambit of movement from closed to open position approximately equal to the length of said chord for permitting access to a tray positioned therebehind, means for dividing circumferentially into two compartments the trays at selected levels, means for limiting the opening movement of the doors at said selected levels to substantially half the normal ambit, means responsive to the deposit of coins aggregating the purchase price of articles at a certain level for freeing said doors for movement toward open positions, means for stepping said carrier in a number of steps equal to twice the number of trays at a level and for accurately stopping said carrier at the end of a step and means for inhibiting opening of a door at a level other than one of said selected levels when said carrier stops at a mid tray point, said supporting means comprising vertically spaced locating and supporting openings in said columns, extensions on said trays adapted to be received in said openings, respective bosses on each of said trays adjacent to the front sides thereof, respective lugs on adjacent partitions adjacent to the outer edges thereof for receiving said bosses, said bosses having portions adapted to engage said lugs in response to a force applied to a tray in a direction radially of the axis of rotation of said carrier to prevent movement of the tray, channel-shaped members having side openings adapted to receive front edge portions of said trays and manually releasable interengageable means on said channel-shaped members and said partitions for holding said members in positions at which the side openings thereof receive portions of said trays to lock said trays in position.

2. An all-purpose merchandiser adapted to vend articles over a wide range of shapes and sizes including in combination a cabinet having a front, a generally circular merchandise carrier within said cabinet, said carrier comprising a center column, a plurality of vertically extending partitions of transparent material supported on said carrier at substantially equal spaced locations therearound to divide said carrier into a plurality of sectors, a plurality of respective merchandise receiving trays, means removably supporting said trays between adjacent pairs of said panels, a plurality of said trays being supported on said panels at vertically spaced locations to divide said carrier into a plurality of levels, a window of transparent material on said front, said window being located in a plane inclined rearwardly from a line relatively adjacent to the center of said front and being substantially parallel to a plane which is tangent to said carrier, a plurality of transparent access doors mounted in said front for movement between open positions and closed positions at levels corresponding to said carrier levels, said doors in said closed positions lying in a plane inclined rearwardly from a line relatively adjacent to the center of said front and generally parallel to a plane tangent to said carrier each of said window and said doors having a width approximately equal to the length of a chord subtended by the space occupied by one of said trays, each of said doors having a normal ambit of movement from closed to open position approximately equal to the length of said chord for permitting access to a tray positioned therebehind, means for dividing circumferentially into two compartments the trays at selected levels, means for limiting the opening movement of the doors at said selected levels to substantially half the normal ambit, means responsive to the deposit of coins aggregating the purchase price of articles at a certain level for freeing said doors for movement toward open positions, means for stepping said carrier in a number of steps equal to twice the number of trays at a level and for accurately stopping said carrier at the end of a step and means for inhibiting opening of a door at a level other than one of said selected levels when said carrier stops at a mid tray point, said supporting means comprising first manually releasable interengageable means on said column and on said trays for supporting said trays on said column and for locating said trays along said column, second manually releasable interengageable means on said trays and on said partitions for supporting said trays on said partition and for retaining said trays on said partitions, said second means restraining said tray from removal in response to a force exerted on said tray in a radial direction with reference to the axis of rotation of said carrier, and third manually releasable means carried by said partitions for locking said trays in place.

3. An all-purpose merchandiser adapted to vend articles over a wide range of shapes and sizes including in combination a cabinet having a front, a generally circular merchandise carrier within said cabinet, said carrier comprising a center column, a plurality of vertically extending partitions of transparent material supported on said carrier at substantially equally spaced locations therearound to divide said carrier into a plurality of sectors, a plurality of respective merchandise receiving trays, means removably supporting said trays between adjacent pairs of said panels, a plurality of said trays being supported on said panels at vertically spaced locations to divide said carrier into a plurality of levels, a window of transparent material on said front, said window being located in a plane inclined rearwardly from a line relatively adjacent to the center of said front and being substantially parallel to a plane which is tangent to said carrier, a plurality of transparent access doors mounted in said front for movement between open positions and closed positions at levels corresponding to said carrier levels, said doors in said closed positions lying in a plane inclined rearwardly from a line relatively adjacent to the center of said front and generally parallel to a plane tangent to said carrier each of said window and said doors having a width approximately equal to the length of a chord subtended by the space occupied by one of said trays, each of said doors having a normal ambit of movement from closed to open positions approximately equal to the length of said chord for permitting access to a tray positioned therebehind, means for dividing circumferentially into two compartments the trays at selected levels, means for limiting the opening movement of the doors at said selected levels to substantially half the normal ambit, means responsive to the deposit of coins aggregating the purchase price of articles at a certain level for freeing said doors for movement toward open positions, means for stepping said carrier in a number of steps equal to twice the number of trays at a level and for accurately stopping said carrier at the end of a step and means for inhibiting opening of a door at a level other than one of said selected levels when said carrier stops at a mid tray point, said tray dividing means comprising a member formed with an article supporting platform located approximately half way between a pair of adjacent vertically aligned trays to form upper and lower compartments, an upper compartment wall extending upwardly from said platform and extending rearwardly from a point adjacent to the midpoint of the tray with which it is associated along a portion of the locus of a chord of the circle described by said carrier, a lower compartment wall extending rearwardly from a point adjacent to said midpoint along a portion of the locus of a second chord of said circle, an upper baffle at the front of said platform for preventing access to said upper compartment in one position of said carrier, and a lower baffle at the front of said platform for preventing access to the lower compartment in an adjacent position of said carrier.

4. An all-purpose merchandiser adapted to vend articles over a wide range of shapes and sizes including in combination a cabinet having a front, a generally circular merchandise carrier within said cabinet, said carrier comprising a center column, a plurality of vertically extending partitions of transparent material supported on said carrier at substantially equally spaced locations therearound to divide said carrier into a plurality of sectors, a plurality of respective merchandise receiving trays, means removably supporting said trays between adjacent pairs of said panels, a plurality of said trays being supported on said panels at vertically spaced locations to divide said carrier into a plurality of levels, a window of transparent material on said front, said window being located in a plane inclined rearwardly from a line relatively adjacent to the center of said front and being substantially parallel to a plane which is tangent to said carrier, a plurality of transparent access doors mounted in said front for movement between open positions and closed positions at levels corresponding to said carrier levels, said doors in said closed positions lying in a plane inclined rearwardly from a line relatively adjacent to the center of said front and generally parallel to a plane tangent to said carrier, each of said window and said doors having a width approximately equal to the length of a chord subtended by the space occupied by one of said trays, each of said doors having a normal ambit of movement from closed to open position approximately equal to the length of said chord for permitting access to a tray positioned therebehind, means for dividing circumferentially into two compartments the trays at selected levels, means for limiting the opening movement of the doors at said selected levels to substantially half the normal ambit, means responsive to the deposit of coins aggregating the purchase price of articles at a certain level for freeing said doors for movement toward open positions, means for stepping said carrier in a number of steps equal to twice the number of trays at a level and for accurately stopping said carrier at the end of a step and means for inhibiting opening of a door at a level other than one of said selected levels when said carrier stops at a mid tray point.

5. An all-purpose merchandiser adapted to vend articles over a wide range of shapes and sizes including in combination a cabinet having a front, a generally circular merchandise carrier within said cabinet, said carrier comprising a center column, a plurality of vertically extending partitions supported on said carrier at substantially equally spaced locations therearound to divide said carrier into a plurality of sectors, respective merchandise receiving trays removably supported between adjacent pairs of said panels, a plurality of said trays being supported on said panels at vertically spaced locations to divide said carrier into a plurality of levels, a window of transparent material on said front, said window being located in a plane inclined rearwardly from a line relatively adjacent to the center of said front and being substantially parallel to a plane which is tangent to said carrier, a plurality of transparent access doors mounted in said front for movement between open positions and closed positions at levels corresponding to said carrier levels, said doors in said closed positions lying in a plane inclined rearwardly from a line relatively adjacent to the center of said front and generally parallel to a plane tangent to said carrier, each of said window and said doors having a width approximately equal to the length of a chord subtended by the space occupied by one of said trays, each of said doors having a normal ambit of movement from closed to open position approximately equal to the length of said chord for permitting access to a tray positioned therebehind, means for dividing circumferentially into two compartments the trays at selected levels, means for limiting the opening movement of the doors at said selected levels to substantially half the normal ambit, means responsive to the deposit of coins aggregating the purchase price of articles at a certain level for freeing said doors for movement toward open positions, means for stepping said carrier in a number of steps equal to twice the number of trays at a level and for accurately stopping said carrier at the end of a step and means for inhibiting opening of a door at a level other than one of said selected levels when said carrier stops at a mid tray point.

6. An all-purpose merchandiser adapted to vend articles over a wide range of shapes and sizes including in combination a cabinet having a front, a generally circular merchandise carrier within said cabinet, said carrier comprising a center column, a plurality of vertically extending partitions supported on said carrier at substantially equally spaced locations therearound to divide said carrier into a plurality of sectors, respective merchandise receiving trays removably supported between adjacent pairs of said panels, a plurality of said trays being supported on said panels at vertically spaced locations to divide said carrier into a plurality of levels, a window of transparent material on said front, said window being located in a plane inclined rearwardly from a line relatively adjacent to the center of said front and being substantially parallel to a plane which is tangent to said carrier, a plurality of transparent access doors mounted in said front for movement between open positions and closed positions at levels corresponding to said carrier levels, said doors in said closed positions lying in a plane inclined rearwardly from a line relatively adjacent to the center of said front and generally parallel to a plane tangent to said carrier each of said window and said doors having a width approximately equal to the length of a chord subtended by the space occupied by one of said trays, each of said doors having a normal ambit of movement from closed to open position approximately equal to the length of said chord for permitting access to a tray positioned therebehind, means responsive to the deposit of coins aggregating the purchase price of articles at a certain level for freeing said doors for movement toward open positions and means for stopping said carrier with one of said sectors aligned with said doors.

7. In a merchandise machine of the type including a circular merchandise carrier having a plurality of superposed merchandise receiving compartments each having a bottom and a pair of side walls, a compartment dividing member having an article supporting platform located approximately halfway between a pair of said compartments to form upper and lower sub-compartments, an upper sub-compartment wall extending upwardly from said platform and extending rearwardly from a point adjacent the midpoint of the compartment with which it is associated along a portion of the locus of a chord of the circle described by said carrier, said platform and said upper sub-compartment side wall and the upper portion of one side wall of said associated compartment comprising said upper compartment, a lower sub-compartment wall extending rearwardly from a point adjacent to said midpoint along a portion of the locus of a second chord of said circle, said associated compartment bottom and said lower sub-compartment side wall and the lower portion of the other side wall of said associated compartment comprising said lower sub-compartment, an upper baffle at the front of said platform for preventing access to said upper compartment in one position of said carrier and a lower baffle at the front of said platform for preventing access to the lower compartment in an adjacent position of said carrier.

8. In a merchandising machine, a merchandise carrier adapted to be rotated around a vertical axis including in combination, a center column, a plurality of vertical partitions mounted on said column at spaced locations therearound, a plurality of article receiving trays and means mounting said trays between adjacent partitions at respective levels on said column, said mounting means comprising first manually releasable interengageable means on said column and on said trays for supporting said trays on said column and for locating said trays along said column, second manually releasable interengageable means on said trays and on said partitions for supporting said trays on said partition and for retaining said trays on said partitions, said second means restraining said tray from removal in response to a force exerted on said tray in a radial direction with reference to the axis of rotation of said carrier, and third manually releasable means carried by said partitions for locking said trays in place.

9. In a merchandising machine, a merchandise carrier adapted to be rotated around a vertical axis including in combination, a center column, a plurality of vertical partitions mounted on said column at spaced locations therearound, a plurality of article receiving trays and means mounting said trays between adjacent partitions at respective levels on said column, said mounting means comprising vertically spaced locating and supporting openings in said columns, extensions on said trays adapted to be received in said openings, respective bosses on each of said trays adjacent to the front sides thereof, respective lugs on adjacent partitions adjacent to the outer edges thereof for receiving said bosses, said bosses having portions adapted to engage said lugs in response to a force applied to a tray in a direction radially of the axis of rotation of said carrier to prevent movement of the tray, channel-shaped members having side openings adapted to receive front edge portions of said tray and manually releasable interengageable means on said channel-shaped members and said partitions for holding said members in positions at which the side openings thereof receive portions of said trays to lock said trays in position.

10. An all-purpose merchandiser adapted to vend a wide range of shapes and sizes of articles in a random manner including in combination, a cabinet having a front formed with an access opening, a transparent door, means mounting said door on said cobinet front for movement between a closed position over said access opening and an open position at which the interior of said cabinet is accessible, a transparent window in said front adjacent to said access opening, a merchandise carrier having a vertical axis and means including a plurality of vertically extending see-through walls for forming a plurality of circumferentially spaced article receiving compartments open at the periphery of said carrier, means mounting said carrier in said cabinet behind said window and said door and for movement around said axis to permit said compartments to register with said door, and customer operable means for selectively positioning one of said compartments in registration with said door, the dimensions of said transparent window and said transparent door and the arrangement of said see-through walls permitting a potential customer to view over half of the compartments in said carrier without rotating the carrier to detect the presence of articles in said compartments.

11. An all-purpose merchandiser adapted to vend articles over a wide range of shapes and sizes including in combination, a cabinet having a front, a generally circular merchandise carrier in said cabinet, means mounting said carrier for movement around a generally vertical axis, means including a plurality of transparent partitions spaced around said carrier for forming a plurality of circumferentially spaced merchandise receiving compartments at respective levels, a window in said front, said window lying in a vertical plane inclined rearwardly from a vertical line adjacent to the center of said front, and a plurality of access doors mounted on said front in superposed relationship at said levels for movement between open position and closed position at which said doors lie in a vertical plane inclined rearwardly from a line adjacent to the center of said front, a first vertically elongated sources of illumination positioned adjacent to the line of intersection of the planes of said doors and said window, a second vertically elongated source of illumination adjacent to the side of said window remote from said line and a third vertically elongated source of illumination adjacent to the sides of said doors remote from said line.

12. An all-purpose merchandiser adapted to vend articles over a wide range of shapes and sizes including in combination, a cabinet having a front, a generally circular merchandise carrier in said cabinet, means mounting said carrier for movement around a generally vertical axis, said carrier having a plurality of circumferentially spaced merchandise receiving compartments at respective levels, a window in said front, said window lying in a vertical plane inclined rearwardly from a vertical line adjacent to the center of said front, and a plurality of access doors mounted on said front in superposed relationship at said levels for movement between open position and closed position at which said doors lie in a vertical plane inclined rearwardly from a line adjacent to the center of said front, a first vertically elongated source of illumination positioned adjacent to the line of intersection of the planes of said doors and said window, a second vertically elongated source of illumination adjacent to the side of said window remote from said line and a third vertically elongated source of illumination adjacent to the sides of said doors remote from said line.

13. An all-purpose merchandiser adapted to vend articles over a wide range of shapes and sizes including in combination, a cabinet having a front, a generally circular merchandise carrier in said cabinet, means mounting said carrier for movement around a generally vertical axis, said carrier having a plurality of circumferentially spaced merchandise receiving compartments at respective levels, a window in said front, said window lying in a vertical plane inclined rearwardly from a vertical line adjacent to the center of said front and parallel to a first plane tangent to said carrier, and a plurality of access doors mounted on said front in superposed relationship at said levels for movement between open position and closed position at which said doors lie in a vertical plane inclined rearwardly from a line adjacent to the center of said front and parallel to a second plane tangent to said carrier.

14. An all-purpose merchandiser adapted to vend articles over a wide range of shapes and sizes including in combination, a cabinet having a front, a generally circular merchandise carrier in said cabinet, means mounting said carrier for movement around a generally vertical axis, said carrier having a plurality of circumferentially spaced merchandise receiving compartments at respective levels, a window in said front, said window lying in a vertical plane inclined rearwardly from a vertical line adjacent to the center of said front, and a plurality of access doors mounted on said front in superposed relationship at said levels for movement between open position and closed position at which said doors lie in a vertical plane inclined rearwardly from a line adjacent to the center of said front.

15. An all-purpose merchandiser adapted to vend articles over a wide range of shapes and sizes including in combination a cabinet having a front, a generally circular merchandise carrier within said cabinet, said carrier comprising forming a plurality of levels of vertically aligned merchandise receiving compartments each of which occupies a sector of the same extent around said carrier, a window of transparent material on said front, said window being located in a plane inclined rearwardly from a line relatively adjacent to the center of said front and being substantially parallel to a plane which is tangent to said carrier, a plurality of transparent access doors mounted in said front for movement between open positions and closed positions at levels corresponding to said carrier levels, said doors in said closed positions lying in a plane inclined rearwardly from a line relatively adjacent to the center of said front and generally parallel to a plane tangent to said carrier, each of said window and said doors having a width approximately equal to the length of a chord subtended by the space occupied by one of said compartments, each of said doors having a normal ambit of movement from closed to open position approximately equal to the length of said chord for permitting access to a compartment positioned therebehind, means for dividing circumferentially into two sub-compartments the compartments at selected levels, means for limiting the opening movement of the doors at said selected levels to substantially half the normal ambit, means responsive to the deposit of coins aggregating the purchase price of articles at a certain level for freeing said doors for movement toward open positions, means for stepping said carrier in a number of steps equal to twice the number of compartments at a level and for accurately stopping said carrier at the end of a step and means for inhibiting opening of a door at a lwevel other than one of said selected levels when said carrier stops at a mid compartment point.

16. An all-purpose merchandiser adapted to vend articles over a wide range of shapes and sizes including in combination a cabinet having a front, a generally circular merchandise carrier within said cabinet, said carrier comprising means forming a plurality of levels of vertically aligned merchandise receiving compartments each of which occupies a sector of the same extent around said carrier, a window of transparent material on said front, a plurality of transparent access doors mounted in said front for movement between open positions and closed positions at levels corresponding to said carrier levels, each of said doors having a normal ambit of movement from closed to open position approximately equal to the width of said segment for permitting access to a compartment positioned therebehind, means for dividing circumferentially into two sub-compartments the compartments at selected levels, means for limiting the opening movement of the doors at said selected levels to substantially half the normal ambit, means responsive to the deposit of coins aggregating the purchase price of articles at a certain level for freeing said doors for movement toward open positions, means for stepping said carrier in a number of steps equal to twice the number of compartments at a level and for accurately stopping said carrier at the end of a step and means for inhibiting opening of a door at a level other than one of said selected levels when said carrier stops at a mid compartment point.

17. An all-purpose merchandiser adapted to vend articles over a wide range of shapes and sizes including in combination a cabinet having a front, a generally circular merchandise carrier within said cabinet, said carrier comprising transparent means forming a plurality of levels of merchandise receiving compartments each having transparent walls and a transparent base, a window of transparent material on said front, a plurality of transparent access doors mounted in said front for movement between open positions and closed positions at levels corresponding to said compartment levels, each of said doors having a normal ambit of movement from closed to open position approximately equal to the width of a compartment for permitting access to a compartment positioned therebehind, means responsive to the deposit of coins aggregating the purchase price of articles at a certain level for freeing said doors for movement toward open positions and means for stopping said carrier with one of said compartments aligned with a door, the dimensions of said window and said doors and the transparency of said walls and bases affording a prospective customer with a view of more than half said compartments without moving said carrier.

18. An all-purpose merchandiser adapted to vend articles over a wide range of shapes and sizes including in combination a cabinet having a front, a generally circular merchandise carrier within said cabinet, said carrier comprising transparent means forming a plurality of levels of merchandise receiving compartments each having transparent walls and a transparent base, a window of transparent material on said front, said window being located in a plane inclined rearwardly from a line relatively adjacent to the center of said front and being substantially parallel to a plane which is tangent to said carrier, a plurality of transparent access doors mounted in said front for movement between open positions and closed positions at levels corresponding to said carrier levels, said doors in said closed positions lying in a plane inclined rearwardly from a line relatively adjacent to the center of said front and generally parallel to a plane tangent to said carrier, each of said windows and said doors having a width approximately equal to the length of a chord subtended by the space occupied by one of said compartments, each of said doors having a normal ambit of movement from closed to open position approximately equal to the length of said chord for permitting access to a compartment positioned therebehind, means responsive to the deposit of coins aggregating the purchase price of articles at a certain level for freeing said doors for movement toward open positions and means for stopping said carrier with one of said compartments aligned with a door, the dimensions of said window and said doors and the transparency of said walls and bases affording a prospective customer with a view of more than half said compartments without moving said carrier.

19. An all-purpose merchandiser adapted to vend articles over a wide range of shapes and sizes including in combination, a drum-like carrier for said articles of merchandise, means on said carrier forming a plurality of sets of merchandise receiving compartments each having transparent walls and a transparent base for supporting an article of merchandise, a cabinet having a front provided with a window and a plurality of aligned doors of transparent material, means mounting said merchandise carrier in said cabinet for movement around an axis with said sets of compartments aligned with the respective doors, means for driving said carrier to move said compartments past said window and said doors, means for selectively opening said doors for access to said compartments and illuminating means in said cabinet for illuminating articles through said transparent walls and base, the dimensions of said window and said doors and the transparency of said walls and bases affording a prospective customer with a view of more than half said compartments without moving said carrier.

20. An all-purpose merchandiser adapted to vend articles over a wide range of shapes and sizes including in combination, a drum-like carrier for said articles of merchandise, means on said carrier forming a plurality of levels of merchandise receiving compartments each having transparent walls and a transparent base for supporting an article of merchandise, a cabinet having a front provided with a vertically extending window and a plurality of vertically aligned doors of transparent material, means mounting said merchandise carrier in said cabinet for movement around a vertical axis with said compartment levels aligned with the respective doors, means for driving said carrier to move said compartments past said window and said doors, means for selectively opening said doors for access to said compartments, the dimensions of said window and said doors and the transparency of said walls and bases affording a prospective customer with a view of more than half said compartments without moving said carrier.

21. An all-purpose merchandiser adapted to vend articles over a wide range of shapes and sizes including in combination, a drum-like carrier for said articles of merchandise, means on said carrier forming a plurality of sets of merchandise receiving compartments each having transparent walls and a base for supporting an article of merchandise, a cabinet having a front provided with a window and a plurality of aligned doors of transparent material, means mounting said merchandise carrier in said cabinet for movement around an axis with said sets of compartments aligned with the respective doors, means for driving said carrier to move said compartments past said window and said doors, means for selectively opening said doors for access to said compartments, the dimensions of said window and said doors and the transparency of said walls and bases affording a prospective customer with a view of more than half said compartments moving said carrier.

22. An all-purpose merchandiser adapted to vend a wide range of shapes and sizes of articles in a random manner including in combination a cabinet having a front formed with a plurality of vertically spaced access openings, a plurality of transparent doors, means mounting said doors on said cabinet front adjacent to the respective openings for movement between closed positions over said openings and open positions at which the interior of said cabinet behind the corresponding opening is accessible, a transparent window in said front adjacent said openings, a merchandise carrier having a generally vertical axis and means forming a plurality of tiers of circumferentially spaced article receiving compartments open at the periphery of the carrier, each of said compartments having a see-through bottom and see-through sides, means mounting said carrier in said cabinet behind said window and said doors with said tiers aligned with said doors, and customer operable means for selectively positioning the compartments of a tier in registry with the associated door, the dimensions of said transparent window and transparent doors and the arrangement of said see-through bottoms and see-through sides permitting a potential customer to view over half of the compartments in said carrier without rotating the carrier to detect the presence of articles in said compartments.

23. An all-purpose merchandiser adapted to vend a wide range of shapes and sizes of articles including in combination, a cabinet having a front formed with a plurality of vertically spaced access openings, all of said access openings being of the same height, a plurality of doors, means mounting said doors on said cabinet front adjacent to the respective openings for movement between closed positions over said openings and open positions at which the interior of the cabinet behind the corresponding opening is accessible, a generally circular merchandise carrier having a generally vertical axis and means forming a plurality of tiers of article receiving compartments open at the periphery of the carrier, the compartments of a first tier associated with one of said doors each having a height approximately equal to said opening height and having a mouth of a certain width at the periphery of the carrier, the compartments of a second tier associated with another of said doors each having heights equal to approximately half said opening heights and having a mouth of said certain width, the compartments of said second tier being alternately upper and lower sub-compartments, means mounting said carrier in said housing for movement around said axis, and means for driving said carrier in steps substantially equal to said mouth width.

24. An all-purpose merchandiser adapted to vend a wide range of shapes and sizes of articles including in combination, a cabinet having a front formed with a plurality of vertically spaced access openings, all of said access openings being of the same height, a plurality of doors, means mounting said doors on said cabinet front adjacent to the respective openings for movement between closed positions over said openings and open positions at which the interior of the cabinet behind the corresponding opening is accessible, a generally circular merchandise carrier having a generally vertical axis and means forming a plurality of tiers of article receiving compartments open at the periphery of the carrier, the compartments of a first tier associated with one of said doors each having a height approximately equal to said opening height and having a mouth of a certain width at the periphery of the carrier, the compartments of said first tier having side walls extending generally radially with reference to the circle described by said carrier, the compartments of a second tier associated with another of said doors, each having heights equal to approximately half said opening heights and having a mouth of said certain width, each compartment of said second tier having a first side wall extending generally radially with reference to said circle and a second side wall extending generally along the locus of a chord of said circle, the compartments of said second tier being alternately upper and lower sub-compartments, means mounting said carrier in said housing for movement around said axis, and means for driving said carrier in steps substantially equal to said mouth width.

25. An all-purpose merchandiser adapted to vend a wide range of shapes and sizes of articles in a random manner including in combination a cabinet having a front formed with a plurality of vertically spaced access openings, a plurality of transparent doors, means mounting said doors on said cabinet front adjacent to the respective openings for movement between closed positions over said openings and open positions at which the interior of said cabinet behind the corresponding opening is accessible, a merchandise carrier comprising a central column having a generally vertical axis and means on said column forming a plurality of tiers of circumferentially spaced article receiving compartments open at the periphery of the carrier, means mounting said carrier in said cabinet for rotary movement around said vertical axis with said tiers aligned with said openings, customer operable means for selectively positioning the compartments of a tier in registry with the associated opening, means normally locking said doors, and means including money responsive means for releasing a door behind which a selected compartment has been positioned.

* * * * *

UNITED STATES PATENT AND TRADEMARK OFFICE

CERTIFICATE OF CORRECTION

PATENT NO. : 4,317,604

DATED : March 2, 1982

INVENTOR(S) : Merrill Krakauer

It is certified that error appears in the above-identified patent and that said Letters Patent are hereby corrected as shown below:

Column 13, line 53 "positions" should read -- position --.

Column 17, line 5, "cobinet" should read -- cabinet --;
line 42, "sources" should read -- source --.

Column 19, line 2, "lwevel" should read -- level --.

Column 20, line 7, "windows" should read -- window --.

Column 21, line 12, after "compartments" insert --without --.

Signed and Sealed this

*Twenty-seventh* Day of *April 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : B1 4,317,604

DATED : March 2, 1982

INVENTOR(S) : MERRILL KRAKAUER

It is certified that error appears in the above-identified patent and that said Letters Patent is hereby corrected as shown below:

Column 4, line 49 - "of" should read -- as in --.

Column 5, line 20 - delete "operable means".

Signed and Sealed this

Twenty-seventh Day of March, 1990

*Attest:*

JEFFREY M. SAMUELS

*Attesting Officer*

*Acting Commissioner of Patents and Trademarks*

REEXAMINATION CERTIFICATE (1071st)

United States Patent [19]

Krakauer

[11] B1 4,317,604

[45] Certificate Issued Jun. 6, 1989

[54] ALL-PURPOSE MERCHANDISER

[76] Inventor: Merrill Krakauer, 1 Deer Path, Short Hills, N.J. 07078

Reexamination Request:
No. 90/001,528, Jun. 20, 1988

Reexamination Certificate for:

| | |
|---|---|
| Patent No.: | **4,317,604** |
| Issued: | **Mar. 2, 1982** |
| Appl. No.: | **146,313** |
| Filed: | **May 5, 1980** |

Certificate of Correction issued Apr. 27, 1982.

[51] Int. Cl.[4] ..... A47F 1/00; A47B 49/00

[52] U.S. Cl. ..... 312/97.1; 312/125; 312/223; 312/305

[58] Field of Search ..... 312/97.1, 125, 305, 312/223, 97, 91, 135, 138 R

[56] References Cited

U.S. PATENT DOCUMENTS

| | | | |
|---|---|---|---|
| 2,016,127 | 10/1935 | Weiler | 312/35 |
| 2,104,497 | 1/1938 | Schulte | 312/97.1 |
| 2,799,173 | 7/1957 | Baird | 74/152 |
| 2,968,518 | 1/1961 | Branusberg | 312/97.1 |
| 3,096,907 | 7/1963 | Bouracier | 221/113 |
| 3,102,761 | 9/1963 | Andrews et al. | 312/35 |
| 3,107,815 | 10/1963 | Wittenborg | 221/76 |
| 3,122,401 | 2/1964 | Johnson | 312/97.1 |
| 3,129,039 | 4/1964 | Staley | 312/97.1 |
| 3,190,706 | 6/1965 | Hatcher et al. | 312/97 |
| 3,390,754 | 7/1968 | Newberry | 194/10 |
| 3,556,284 | 1/1971 | Dyer | 198/138 |
| 4,049,154 | 9/1977 | Burks | 221/76 |
| 4,192,436 | 3/1980 | Schuller et al. | 221/129 |

FOREIGN PATENT DOCUMENTS

| | | |
|---|---|---|
| 1775408 | 9/1958 | Fed. Rep. of Germany . |
| 1844430 | 10/1961 | Fed. Rep. of Germany . |
| 1248991 | 8/1967 | Fed. Rep. of Germany . |
| 802311 | 9/1936 | France . |
| 1137888 | 6/1957 | France . |
| 1167446 | 10/1969 | United Kingdom . |

*Primary Examiner*—Victor N. Sakran

[57] ABSTRACT

An all-purpose merchandiser for vending articles of merchandise, such as platters of food, desserts and the like, having a wide variety of shapes and sizes in which a generally circular merchandise carrier having a plurality of storage levels each of which is divided into a plurality of compartments having transparent walls and bases is mounted for movement around a vertical axis to carry the compartments past a cabinet door window and past a plurality of transparent access doors disposed for sliding movement in superposed relationship on the cabinet door. The dimensions of the windows and the doors and the transparency of compartment walls and bases afford a potential customer with a view of more than half the compartments on the carrier without moving the carrier so that he is able to determine the presence of articles therein. Preferably the windows and the doors are in planes extending slightly rearwardly from the midpoint of the cabinet door.

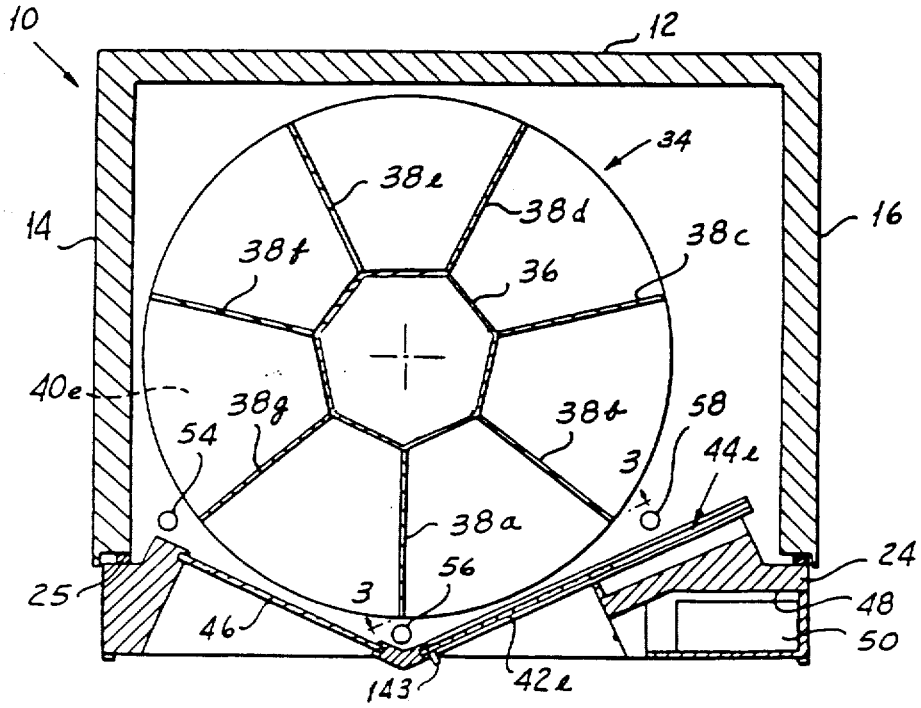

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the atent, but has been deleted and is no longer a part of the atent; matter printed in italics indicates additions made o the patent.

AS A RESULT OF REEXAMINATION, IT HAS BEEN DETERMINED THAT:

The patentability of claims 1–9, 11–16, 18, 23 and 24 ; confirmed.

Claims 10, 17, 19–22 and 25 are determined to be atenable as amended.

New claims 26–33 are added and determined to be atentable.

10. An all-purpose merchandiser adapted to vend a ide range of shapes and sizes of articles in a random ianner including in combination, a *generally rectangu-ir* cabinet having a front formed with an access open-ig *at one side of a vertical line adjacent to the center of iid cabinet and disposed in a plane inclined rearwardly om said line*, a transparent door, means mounting said oor on said cabinet front for movement *in said plane* etween a closed position over said access opening and a open position at which the interior of said cabinet is ccessible, a transparent window in said front adjacent said access opening *on the other side of said line*, a *rcular* merchandise carrier having a vertical axis and ieans including a plurality of vertically extending see-irough walls for forming a plurality of circumferen-ally spaced article receiving compartments open at the eriphery of said carrier, means mounting said carrier in iid cabinet behind said window and said door and for iovement around said axis to permit said compart-ients to register with said door, *said plane being parallel a plane tangent to said carrier*, and customer operable ieans for selectively positioning one of said compart-ients in [registration] *register* with said door, the imensions of said transparent window and said trans-arent door and the arrangement of said see-through alls permitting a potential customer to view over half f the compartments in said carrier without rotating the irrier to detect the presence of articles in said compart-ents.

17. An all-purpose merchandiser adapted to vend ticles over a wide range of shapes and sizes including combination a cabinet having a front, a generally rcular merchandise carrier within said cabinet, said irrier comprising transparent means forming a plural-y of levels of merchandise receiving compartments ich having transparent walls and a transparent base, *ich of said compartments occupying a sector of the same ctent around said carrier*, a window of transparent ma-rial on said front, a plurality of transparent access oors mounted in said front for movement between pen positions and closed positions at levels corre-onding to said compartment levels, each of said doors aving a normal ambit of movement from closed to pen position approximately equal to the width of a compartment for permitting access to a compartment positioned therebehind, *means for dividing circumferentially into two subcompartments the compartments at selected levels, means for limiting the opening movement of doors at said selected levels to substantially half the normal ambit*, means responsive to the deposit of coins aggregating the purchase price of articles at a certain level for freeing said doors for movement toward open positions, *means for stepping said carrier in a number of steps equal to twice the number of compartments at a level*, [and] means for *accurately* stopping said carrier *at the end of a step* with one of said compartments *or subcompartments* aligned with a door *and means for inhibiting opening of a door at a level other than one of said selected levels when said carrier stops at a mid-compartment point*, the dimensions of said window and said doors and the transparency of said walls and bases affording a prospective customer with a view of more than half said compartments without moving said carrier.

19. An all-purpose merchandiser adapted to vend articles over a wide range of shapes and sizes including in combination, a drum-like carrier for said articles of merchandise, means on said carrier forming a plurality of sets of merchandise receiving compartments each having transparent walls and a transparent base for supporting an article of merchandise, a cabinet having a front provided with a window and a plurality of aligned doors of transparent material, means mounting said merchandise carrier in said cabinet for movement around an axis with said sets of compartments aligned with the respective doors, *means for dividing circumferentially into subcompartments the compartments of a particular set, means for limiting the opening movement of the doors associated with said particular set to the width of a subcompartment of the set*, means for driving said carrier to move said compartments past said window and said doors, *means for stopping said carrier with one of said compartments or subcompartments of a particular set aligned with a door*, means for selectively opening said doors for access to said compartments, *means for inhibiting opening movement of a door of a set other than said particular set when said carrier stops at an intra compartment or intra subcompartment position of said other set* and illuminating means in said cabinet for illuminating articles through said transparent walls and base, the dimensions of said window and said doors and the transparency of said walls and bases affording a prospective customer with a view of more than half said compartments without moving said carrier.

20. An all-purpose merchandiser adapted to vend articles over a wide range of shapes and sizes including in combination, a drum-like carrier for said articles of merchandise, means on said carrier forming a plurality of levels of merchandise receiving compartments each having transparent walls and a transparent base for supporting an article of merchandise, a cabinet having a front provided with a vertically extending window and a plurality of vertically aligned doors of transparent material, means mounting said merchandise carrier in said cabinet for movement around a vertical axis with said compartment levels aligned with the respective doors, *means for dividing circumferentially into subcompartments the compartments of certain levels, means for limiting the opening movement of the doors of said certain levels to the width of a subcompartment of the associated level*, means for driving said carrier to move said compartments past said window and said doors, *means for*

*stopping said carrier with one of said compartments or subcompartments of a particular level aligned with a door,* means for selectively opening said doors for access to said compartments, *means for inhibiting opening movement of a door of a level other than said particular level when said carrier stops at an intra compartment or intra subcompartment position of said other level,* the dimensions of said window and said doors and the transparency of said walls and bases affording a prospective customer with a view of more than half said compartments without moving said carrier.

21. An all-purpose merchandiser adapted to vend articles over a wide range of shapes and sizes including in combination, a drum-like carrier for said articles of merchandise, means on said carrier forming a plurality of sets of merchandise receiving compartments each having transparent walls and a base for supporting an article of merchandise, a cabinet having a front provided with a window and a plurality of aligned doors of transparent material, means mounting said merchandise carrier in said cabinet for movement around an axis with said sets of compartments aligned with the respective doors, *means for dividing circumferentially into subcompartments the compartments of at least one selected set, means for limiting the opening movement of the door associated with a selected set to the extent of a subcompartment of said set,* means for driving said carrier to move said compartments past said window and said doors, *means for accurately positioning said carrier with one of said subcompartments in register with its associated door, means normally locking said doors,* means for selectively opening said doors for access to said compartments, *and subcompartments, and means for inhibiting opening of a door corresponding to a set other than that corresponding to said associated door when the carrier is in an intra compartment or intra subcompartment position with relation to the opening associated with the other set,* the dimensions of said window and said doors and the transparency of said walls and bases affording a prospective customer with a view of more than half said compartments without moving said carrier.

22. An all-purpose merchandiser adapted to vend a wide range of shapes and sizes of articles in a random manner including in combination a cabinet having a front formed with a plurality of vertically spaced access openings, a plurality of transparent doors, means mounting said doors on said cabinet front adjacent to the respective openings for movement between closed positions over said openings and open positions at which the interior of said cabinet behind the corresponding opening is accessible, a transparent window in said front adjacent said openings, a merchandise carrier having a generally vertical axis and means forming a plurality of tiers of circumferentially spaced article receiving compartments open at the periphery of the carrier, each of said compartments having a see-through bottom and see-through sides, means mounting said carrier in said cabinet behind said window and said doors with said tiers aligned with said doors, *means for dividing circumferentially into subcompartments the compartments of certain tiers, means for limiting the opening movement of the doors of said certain tiers to the width of a subcompartment of the associated tier, means for stopping said carrier with one of said compartments or subcompartments of a particular tier aligned with a door,* [and] customer operable means for selectively positioning the compartments of a tier in [registry] *register* with the associated door, *and means for inhibiting opening movement of a door of a tier other than said particular tier when said carrier stops at an intra compartment or intra subcompartment position of said other tier,* the dimensions of said transparent window and transparent doors and the arrangement of said see-through bottoms and see-through sides permitting a potential customer to view over half of the compartments in said carrier without rotating the carrier to detect the presence of articles in said compartments.

25. An all-purpose merchandiser adapted to vend a wide range of shapes and sizes of articles in a random manner including in combination a cabinet having a front formed with a plurality of vertically spaced access openings, a plurality of transparent doors, means mounting said doors on said cabinet front adjacent to the respective openings for movement between closed positions over said openings and open positions at which the interior of said cabinet behind the corresponding opening is accessible, a *generally circular* merchandise carrier comprising a central column having a generally vertical axis and means on said column forming a plurality of tiers of circumferentially spaced article receiving compartments open at the periphery of the carrier, means mounting said carrier in said cabinet for rotary movement around said vertical axis with said tiers aligned with said openings, *each of said compartments occupying a sector of the same extent around said carrier, each of said doors having a normal ambit of movement from closed to open position approximately equal to the width of said sector for permitting access to a compartment positioned therebehind, means for dividing circumferentially into two subcompartments the compartments of selected tiers, means for limiting the opening movement of the doors at said selected tiers to substantially half the normal ambit, means for stepping said carrier in a number of steps equal to twice the number of compartments of a tier and for accurately stopping said carrier at the end of a step,* customer operable means for selectively positioning the compartments of a tier in [registry] *register* with the associated opening, means normally locking said doors, [and] means including money responsive means for releasing a door behind which a selected compartment has been positioned *and means for inhibiting opening movement of a door of a tier other than one of said selected tiers when said carrier stops at a mid-compartment point* .

*26. A merchandiser as in claim 16 in which said inhibiting means comprises means for disabling the door-freeing means associated with said other level.*

*27. A merchandiser of claim 16 in which said doors are mounted for sliding movement, said movement limiting means comprising removable stops in the path of movement of doors at selected levels.*

*28. A merchandiser as in claim 16 in which said cabinet is generally rectangular, said window being located at one side of a vertical line adjacent to the center of said front, said doors being located at the other side of said line for movement in a plane inclined rearwardly from said line and generally parallel to a plane tangent to said carrier.*

*29. An all-purpose merchandiser adapted to vend a wide range of shapes and sizes of articles in a random manner including in combination a cabinet having a front formed with a plurality of vertically spaced access openings, a plurality of transparent doors, means mounting said doors on said cabinet front adjacent to the respective openings for movement between closed positions over said openings and open positions at which the interior of said cabinet behind the corresponding opening is accessible, a unitary merchandise carrier comprising a central column having a generally*

*vertical axis and means on said column forming a plurality of tiers of circumferentially spaced article receiving compartments open at the periphery of the carrier, means mounting said carrier in said cabinet for rotary movement around said vertical axis with said tiers aligned with said openings, means for dividing the compartments of at least one of said tiers into subcompartments, means for limiting the opening movement of the door associated with said one tier to the width of one of said subcompartments, means normally locking said doors, means including money-responsive means for unlocking said doors, customer operablemeans for selectively and accurately positioning said carrier with one of said subcompartments in register with its associated door and means for inhibiting opening of a door associated with another tier when the carrier is accurately positioned with one of said subcompartments in register with its associated door and in an intra compartment position with relation to the opening associated with the other tier. operable means*

*30. A merchandiser as in claim 29 in which said inhibiting means comprises means for disabling the unlocking means associated with the door of said other tier.*

*31. An all-purpose merchandiser adapted to vend articles over a wide range of shapes and sizes including in combination a cabinet having a front, a generally circular merchandise carrier within said cabinet, said carrier comprising transparent means forming a plurality of levels of merchandise receiving compartments each having transparent walls and a transparent base, a window of transparent material on said front, a plurality of transparent access doors mounted in said front for movement between open positions and closed positions at levels corresponding to said compartment levels, each of said doors having a normal ambit of movement from closed to open position approximately equal to the width of a compartment for permitting access to a compartment positioned therebehind, means for dividing circumferentially into subcompartments the compartments at selected levels, means for limiting the opening movement of the doors at said selected levels to the width of a subcompartment at the associated level, means responsive to the deposit of coins aggregrating the purchase price of articles at a certain level for freeing said doors for movement toward open positions, means for stopping said carrier with one of said compartments or subcompartments of a particular level accurately aligned with a door, and means for inhibiting opening of a door at a level other than said particular level when said carrier stops at an intra compartment or intra subcompartment position of said other level, the dimensions of said window and said doors and the transparency of said walls and bases affording a prospective customer with a view of more than half said compartments without moving said carrier.*

*32. An all-purpose merchandiser adapted to vend a wide range of shapes and sizes of articles in a random manner including in combination a generally rectangular cabinet having a front formed with a vertical window at one side of a vertical line relatively adjacent to the center of the front and with a plurality of vertically aligned spaced access openings located at the other side of said line, a generally cylindrical merchandise carrier comprising a central column having a generally vertical axis and means on said column forming a plurality of tiers of circumferentially spaced article receiving compartments open at the periphery of the carrier, means mounting said carrier in said cabinet for rotary movement around said vertical axis and with said tiers aligned with said openings, said access openings being disposed in a plane which is inclined rearwardly from said vertical line and which is generally parallel to a plane tangent to the carrier, a plurality of transparent doors, means mounting said doors on said cabinet front adjacent to the respective openings for movement in said plane between closed positions over said openings and open positions at which the interior of said cabinet behind the corresponding openings is accessible, customer operable means for selectively positioning the compartments of a tier in register with the associated opening, means normally locking said doors and means including money responsive means for releasing a door behind which a selected compartment has been positioned.*

*33. An all-purpose merchandiser adapted to vend articles over a wide range of shapes and sizes including in combination, a drum-like carrier for said articles of merchandise, means on said carrier forming a plurality of levels of merchandise receiving compartments each having transparent walls and a transparent base for supporting an article of merchandise, a generally rectangular cabinet of opaque material having a front provided with a vertically extending window at one side of a vertical line adjacent the center of said front and a plurality of vertically aligned doors of transparent material at the other side of said line, means mounting said merchandise carrier in said cabinet for movement around a vertical axis with said compartment levels aligned with the respective doors, means mounting said doors on said front for sliding movement in a plane inclined rearwardly from said line and generally parallel to a plane tangent to the carrier, means for driving said carrier to move said compartments past said window and doors, means for selectively opening said doors for access to said compartments, the dimensions of said window and said doors and the transparencey of said walls and bases affording a prospective customer with a view of more than half said compartments without moving said carrier.*

* * * * *